US011404762B2

(12) United States Patent
Ryden

(10) Patent No.: US 11,404,762 B2
(45) Date of Patent: Aug. 2, 2022

(54) ANTENNA SYSTEM

(71) Applicant: SAAB AB, Linkoeping (SE)

(72) Inventor: Jan Ryden, Moelnlycke (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/772,841

(22) PCT Filed: Dec. 28, 2017

(86) PCT No.: PCT/SE2018/050007
§ 371 (c)(1),
(2) Date: Jun. 15, 2020

(87) PCT Pub. No.: WO2019/132747
PCT Pub. Date: Jul. 4, 2019

(65) Prior Publication Data
US 2021/0167484 A1 Jun. 3, 2021

(51) Int. Cl.
*H01Q 1/12* (2006.01)
*H01Q 1/18* (2006.01)
*H01Q 1/00* (2006.01)

(52) U.S. Cl.
CPC ..... *H01Q 1/185* (2013.01); *H01Q 1/005* (2013.01); *H01Q 1/1235* (2013.01)

(58) Field of Classification Search
CPC ..... H01Q 1/185; H01Q 1/1235; H01Q 1/005; H01Q 1/1264; H01Q 1/3216; H01Q 1/12
See application file for complete search history.

(56) References Cited

U.S. PATENT DOCUMENTS 4,658,260 A * 4/1987 Myer ..... H01Q 1/10 343/730
5,426,444 A 6/1995 Sauter et al.
(Continued)

FOREIGN PATENT DOCUMENTS

CN 104773671 * 7/2015
CN 104773671 A 7/2015
(Continued)

OTHER PUBLICATIONS

Translation of CN 104773671 (Year: 2015).*
(Continued)

*Primary Examiner* — Awat M Salih
(74) *Attorney, Agent, or Firm* — Alston & Bird LLP

(57) ABSTRACT

The disclosure relates to an antenna system [1] comprising a mast [7], in turn comprising a base section [2*b*] and an extendable section [a], and an antenna [6]. The antenna [6] is arranged to be rotatable and the extendable section [2*a*] comprises a plurality of telescopic sections [8] whereby the extendable section [2*a*] may adopt a retracted configuration and a deployed configuration. The mast [7] is foldable in relation to a platform [5] in a vertical plane [PLxy] essentially parallel to the longitudinal direction of the extendable section [LD-es] and to the longitudinal direction of the base section [LD-bs] by means of a first pivot joint [9]. According to the disclosure the antenna system [1] may be arranged to the platform [5], wherein the platform [5] may be in form of a vehicle [5-*v*], whereby an antenna arrangement [101] is formed. The disclosure further relates to methods of avoiding oscillations for an antenna system [1] and/or an antenna arrangement [101], and to a method of undeploying an antenna arrangement [101].

13 Claims, 11 Drawing Sheets

(56) References Cited

U.S. PATENT DOCUMENTS

| | | | | |
|---|---|---|---|---|
| 5,980,070 | A | 11/1999 | Hulse et al. | |
| 6,046,706 | A * | 4/2000 | Vargas | H01Q 1/1235 343/880 |
| 6,299,336 | B1 | 10/2001 | Hulse | |
| 6,546,677 | B1 | 4/2003 | Featherstone | |
| 7,000,357 | B1 | 2/2006 | Steams et al. | |
| 2008/0258931 | A1 | 10/2008 | Christensen et al. | |
| 2014/0370935 | A1 * | 12/2014 | Newman | H01Q 1/246 455/562.1 |

FOREIGN PATENT DOCUMENTS

| | | | | |
|---|---|---|---|---|
| DE | 3703804 | A1 * | 8/1987 | H01Q 1/1235 |
| DE | 3703804 | A1 | 8/1987 | |
| KR | 101508679 | | 4/2015 | |
| RU | 2265262 | | 11/2005 | |
| SE | 505784 | C2 | 10/1997 | |

OTHER PUBLICATIONS

International Searching Authority (ISA), International Search Report and Written Opinion for International Application No. PCT/SE2018/050007, dated Aug. 31, 2018, 10 pages, Swedish Patent and Registration Office, Sweden.

International Preliminary Examining Authority, International Preliminary Report on Patentability Chapter II for International Application No. PCT/SE2018/050007, including Applicant's Sep. 19, 2019 Response to the ISA's Written Opinion, dated Mar. 19, 2020, 24 pages, European Patent Office, Netherlands.

European Patent Office, Extended European Search Report received for Application No. 18895236.0, dated Jul. 9, 2021, 15 pages, Germany.

* cited by examiner

ANTENNA SYSTEM

CROSS REFERENCE TO RELATED APPLICATIONS

This application is a National Stage Application, filed under 35 U.S.C. 371, of International Application No. PCT/SE2018/050007, filed Dec. 28, 2017; the contents of which is hereby incorporated by reference in its entirety.

BACKGROUND

Related Field

The disclosure relates to an improved, more flexible, antenna system, an antenna arrangement and methods related thereto. The disclosed antenna system can be arranged to a vehicle, such as e.g. a terrain vehicle.

Description of Related Art

The performance in terms of reach and accuracy of antenna systems is determined by a number of factors whereof elevation, i.e. the height the antenna can be elevated to, of the antenna is one of the most influential. Mobile antenna systems, i.e. radar antennas or similar arranged to vehicles, have operational advantages since they offer improved flexibility since they fairly easy can be relocated. Antenna systems of mobile applications generally consist of an antenna arm, preferably articulated or foldable, that once the vehicle is in position can be extended to elevate the antenna up to operational height. Operational height is herein defined as the height at which the antenna system is capable of performing a required task or to operate properly. The mobility of such a system is appreciated since they often operate in hostile territory, often close to the enemy due to limited antenna reach. Eliminating the surveillance and communication infrastructure of an enemy often is highly prioritized in conflicts. Mobility comprises both that the vehicle has to be capable of driving through tough terrain and that operating the antenna has to be rapid. This means that for mobile antenna systems with elevatable antennas it is appreciated that both elevating and lowering of the antenna can be done quickly. Thus, mobility often comes to the price of limited reach of mobile antenna systems due to limited elevation capability of the antenna. Another aspect of mobile antenna systems is that, since the mobile antenna systems often operate in tough terrain and in challenging conditions, the antenna system is exposed to both mechanical and environmental stress.

Antenna systems transported by trucks or similar are often capable of operating at a higher altitude than the mobile antenna systems referred to above, but they generally have the disadvantage that mounting and dismounting of the antenna mast is very time consuming. Such antenna systems are generally referred to as transportable antenna systems, not to confuse with mobile antenna systems referred to above.

Generally, higher masts, such as extendable or in other way highly elevated masts used for e.g. radar applications, electricity pylons or radio transmission are exposed to significant forces due to continuous wind and/or wind gusts. If provided with an essentially horizontally directed, rotating surface, such as a flat radar antenna or a parabolic disc, the mast is additionally exposed to oscillating forces as the surface area of the antenna exposed to wind varies with the rotations of the surface. The same applies if the essentially horizontally directed surface scans over a sector of a circle instead of rotating 360 degrees. This may cause that the mast starts to self-oscillate. If a mast starts to self-oscillate the top of the mast will periodically move back and forth whereby the performance of the antenna may be affected and, if not counteracted, this may also lead to shortened lifetime of the mast or to that the mast eventually breaks. Self-oscillation also exposes the platform or structure the antenna mast is arranged to, as well as the fastening arrangement of the antenna mast arranging the antenna mast to the platform or structure, for high loads. This may degrade and shorten the lifetime of the supporting structure and/or of the fastening arrangement. Mobile antenna systems arranged to e.g. a vehicle, and also less mobile, higher antenna systems, arranged to e.g. a truck, are also exposed to the risk of tipping over. This risk is especially evident if the antenna is in an elevated position, the antenna is exposed to wind and the ground on which the vehicle, truck or similar is standing on leans or is uneven.

Thus, there is need for improvements.

BRIEF SUMMARY

With the above description in mind, then, an exemplary object of the present disclosure is to provide a flexible antenna system which seeks to mitigate or eliminate one or more of the above identified deficiencies and disadvantages of prior art. More particularly, aspects of the present disclosure provide antenna systems which are more operationally flexible in terms of e.g. improved ability to adapt after current terrain and conditions and in terms of providing an easier and faster antenna deployment.

Exemplary objects are achieved by the features of the characterising portion of claim 1. The present disclosure is further defined by the appended independent claims. Various examples of the present disclosure are set forth by the appended dependent claims as well as by the following description and the accompanying drawings. Yet objects of the present disclosure are to provide methods of avoiding oscillations and of storing an antenna system.

Thus, the present disclosure refers to an antenna system. According to the present disclosure the antenna system comprises;

A mast, wherein the mast comprises a base section and an extendable section. According to an aspect of the present disclosure an upper end of the base section is arranged to a lower end of the extendable section and a lower end of the base section is configured to be arrangeable to a platform. Platform is herein defined as a structure, e.g. a terrain vehicle or a stationary structure, to which the mast of the antenna system is configured to be arranged. The base section is defined as the section of the mast that in one end, what here is referred to as lower end, is configured to be arranged to the platform. The position on the platform where the base section is arranged to the platform is referred to as attachment point. As will be described more in detail later on, this is the vertically lower end when the antenna is in an upright position. Consequently, the opposite end of the base section is referred to as the upper end, i.e. upper when the mast is in an upright position. This upper end of the base section is arranged to be connected to the lower end of the extendable section. The extendable section is defined as a section of the mast for which it is possible to consciously decide the extension, i.e. the distance between the opposite lower end and upper end of the extendable section. The vertically lower end of the extendable section when the antenna is in an upright position is referred to as lower end and consequently the opposite end of the extendable section is referred to as the upper end, i.e. upper when the mast is in an upright position.

The antenna system further comprises;

An antenna, wherein the antenna is arranged to be connected to an upper end of the extendable section and wherein the antenna is arranged to be rotatable in a plane essentially perpendicular to a longitudinal direction of the antenna. This is further clarified in the detailed description below. Antenna is herein defined as being any form of electronically steerable sensor such as e.g. a Passive Electronically Steerable Antenna, PESA, or Active Electronically Steerable Antenna, AESA. The longitudinal direction of the antenna is defined as the direction essentially coinciding with the height of the antenna, which not necessarily is a direction being parallel to a surface of the antenna. The antenna is arranged to be connected to the upper end of the extendable section in a way such that the antenna may rotate, e.g. by means of a turntable or other similar rotation means enabling the antenna to be rotated in relation to the extendable section.

Thus, according to one exemplary aspect of the present disclosure the antenna is an electronically steerable antenna, also referred to a phased array antenna, comprising at least two antenna elements. An electronically steerable antenna may be defined as a computer controlled array of antenna elements, wherein each antenna element is capable of transmitting and/or receiving. By controlling the phase of the transmitted microwaves the electronically steerable antenna can be electronically steered to point in a certain direction without moving the antenna.

In order to compensate for deviation of measurements, such as e.g. angular deviations or deviations in terms of signal strength, or similar due to that the elevated antenna moves when being exposed to e.g. wind, it is important to continuously, in real time, know what the deviation, or the error caused by the deviation, is. The deviation/error may e.g. be measured by sensors configured to measure the direction, movements and/or position of the antenna. The deviation may also be determined by predicting, estimating and/or approximating by means of e.g. algorithms designed for this specific purpose. Such predictions etc. may be based on measurements of indirect factors.

According to one aspect of the present disclosure, utilizing an electronically steerable antenna has the exemplary advantage that movements of the antenna can be compensated for, as long as the deviation due to such movements is known, electronically. Such compensation may e.g. be performed by adjusting the direction of the electronically steerable antenna, and may e.g. be performed by means of any form of computer device using algorithms and/or computer programs for controlling the electronically steerable antenna.

According to another aspect of the present disclosure, as long as the deviation due to movements of the antenna is known, the deviation may be compensated for by applying a correction model when processing measurement data, such as e.g. a correction algorithm or a correction mapping.

Thereby the rigidity or stability of the mast becomes less important. That the antenna is an electronically steerable antenna is an option for all aspects, or combination of aspects, of antenna systems and antenna arrangements disclosed herein.

The extendable section comprises a plurality of telescopic sections. The telescopic sections may be, but are not limited to be, coaxially aligned. Each telescopic section has walls extending essentially in the longitudinal direction of the extendable section. The outer transverse dimension of an innermost arranged telescopic section is smaller than the inner transverse dimension of an outermost arranged telescopic section of two adjacent telescopic sections, such that the innermost telescopic section is capable of sliding longitudinally in and out of the outermost telescopic section. Transverse dimension is herein defined as the cross section of the section. This is also referred to as telescoping functionality and will be further disclosed in the detailed description below. Thereby the extendable section may adopt a retracted configuration and a deployed configuration. The retracted configuration is defined as a configuration where the extendable section, i.e. the upper section of the mast comprising a plurality of telescopic sections with successively decreasing inner and outer transverse dimensions, and whereof each adjacent pair of telescopic sections is arranged such that the two telescopic sections are capable of sliding in and out of one another, are slid into one another, whereby the extendable section is shortened. The deployed configuration is defined as a configuration where the telescopic sections are as far telescoped, i.e. lengthwise separated from one another, as the current telescopic construction allows.

The longitudinal and transverse extension of the platform defines a horizontal plane. A vertical plane is defined as being perpendicular to the horizontal plane.

The upper end of the base section is arranged to the lower end of the extendable section by means of a first pivot joint, whereby the extendable section is foldable in relation to the base section in the vertical plane, wherein the vertical plane is parallel to the longitudinal direction of the extendable section and to the longitudinal direction of the base section. Thus, the first pivot joint is arranged between the base section and the extendable section whereby the extendable section can be folded in relation to the base section.

An exemplary effect of the disclosure is that such antenna system provides superior flexibility in relation to existing solutions. The superior flexibility comes from that by arranging an antenna to a foldable mast with telescoping functionality the antenna can be freely positioned, within the range of reach provided by the extendable section, and by means of possibly folding the extendable section in relation to the base section. Thereby it is possible to better adapt the antenna system according to prevailing conditions, current terrain and purpose or operation.

Also, by adapting the elevation of the antenna, i.e. the degree of extension/retraction of the extendable section of the mast, in relation to current excitation frequency the antenna system is exposed to, it is possible to change the natural frequency of the antenna system such that the natural frequency do not match the excitation frequency, i.e. resonance is avoided.

The longitudinal direction of the extendable section is defined as the direction coinciding with the extension of the part of extendable section arranged to the first pivot joint and the longitudinal direction of the base section is defined as the direction coinciding with the extension of the base section. The longitudinal direction of the mast is defined as the direction being essentially perpendicular to the longitudinal direction of the platform, i.e. a direction perpendicular to the horizontal plane. Thus the longitudinal direction of the mast refers to the direction of the mast when the mast is arranged in an upright position.

Generally, for all construction equipment, cranes, construction machines and similar it is important that the top of the crane or similar is as stable as possible. This applies particularly for e.g. cranes where the operating cabin of the crane is situated at the top of the crane, but also for other cranes where it e.g. is important to be able to move building material between certain locations. Thus, the operating height of the crane or similar is a limiting factor and the higher the crane or similar is the more robust the construction has to be. This means that e.g. thicker goods or more complex support structures have to be used. Thicker good, adding of support structures or similar results in impaired usability with less flexible and more stationary constructions. The constructions of such machines are further often primarily designed to manage heavy lifting.

For elevated antenna systems, of which examples are disclosed herein, the challenges are different. Antenna systems having a rotating antenna arranged in top of the mast are, particularly in windy conditions and due to the periodically changing surface area exposed to wind, exposed to other types of external forces. For any aspect of an antenna system according to the present disclosure the stability of the mast is important from a durability perspective. If the oscillations of the mast, induced e.g. due to that the mast and antenna is exposed to wind, become too severe or if the mast enters resonance the mast and antenna installation may be severely degraded.

However, for the present disclosure limited oscillations and/or movements of the antenna are generally not a problem since as long as the movements of the antenna can be measured, predicted, determined, estimated and/or approximated algorithms can be designed to compensate for such movements or other corrections models can be used.

The longitudinal movements of the telescopic sections, i.e. the telescoping functionality, are enabled by any of the commonly known means of providing such functionality. This may e.g. include a rack and pinion arrangement, use of a wire winch or a hydraulics and actuator arrangement.

As previously mentioned, the respective ends of the extendable section and of the base section are herein referred to as upper and lower ends. This is an indexing which refers to when the mast is in an upright position, and is intended to facilitate the understanding of how the present disclosure is designed.

According to aspects of the disclosure the antenna is arranged to the upper end of the extendable section by means of a turntable, whereby the antenna is rotatable in a plane essentially perpendicular to a longitudinal direction of the antenna. When the antenna system is arranged in an upright position, and the platform is standing on essentially flat and not leaning ground, the antenna is rotatable in the horizontal plane. A turntable, enabling rotation of an antenna, is an example of a feature that may contribute to that the antenna system is exposed to oscillating forces. In windy conditions the rotation of the antenna, i.e. the surface of the antenna, leads to that the surface area exposed to wind varies with the rotation of the antenna, thus the force the antenna system is exposed to due to wind varies.

Even if what herein is referred to as platform generally is referred to as a form of vehicle, it is also possible to arrange aspects of antenna systems to stationary platforms. For this aspect of the disclosure the platform is not part of the disclosure itself, but the antenna system is configured to be able to arrange to a platform. However, as is apparent from the disclosure herein and as is further discussed below, the present disclosure, and all exemplary effects, also comprises, and is considered to apply for, an antenna arrangement comprising and antenna system and a platform in form of a vehicle.

The extendable section comprising a plurality of telescopic sections can also be described as comprising a plurality of interconnected tubular sections, wherein each tubular section comprises an essentially hollow body.

The number of telescopic sections of the extendable section may be described as a function of the longitudinal length of the telescopic sections, the longitudinal length of the mast, the configuration of the platform in terms of e.g. stability, the longitudinal and transverse dimensions, stiffness of the mast etc.

According to aspects of the present disclosure the mast comprises a base section and an extendable section, wherein an upper end of the base section is arranged to a lower end of the extendable section, and wherein a lower end of the base section is configured to be arrangeable to the platform. The antenna is arranged in connection to the upper end of the extendable section and the upper end of the base section is arranged to the lower end of the extendable section by means of the first pivot joint. According to aspects of the present disclosure the antenna may be arranged to the upper end of the extendable section by means of a second pivot joint.

According to aspects of the disclosure an angle A between an axis extending in the longitudinal direction of the base section and an axis extending in the longitudinal direction of the extendable section is selected such that a centre of gravity of the antenna is offset longitudinally from where the base section is configured to be arrangeable to the platform, i.e. the attachment point of the mast. For simplicity reasons this is simply referred to as that an angle A between the longitudinal direction of the base section and the longitudinal direction of the extendable section is selected such that a centre of gravity of the antenna is offset. Remember that the longitudinal direction of the extendable section is defined as the extension of the part of the extendable section arranged to the first pivot joint.

Offsetting or displacing the centre of gravity in relation to the attachment point of the mast has the exemplary effect that the mast always will be exposed to a load, i.e. a load generated by the weight of the antenna. This in turn has the exemplary effect of clearance minimization of the antenna system. This is particularly important for the present disclosure since the telescopic functionality of the antenna system provides a larger number of interacting components, thus a large number of clearances and interacting tolerances.

According to aspects of the present invention the centre of gravity is offset longitudinally or displaced such that the centre of gravity is located, given the longitudinal direction of a vehicle, behind the attachment point of the antenna to the vehicle, i.e. closer to the rear of the vehicle.

By means of the first pivot joint, i.e. by lowering or raising the antenna, it is possible to shift the centre of gravity backwards or forwards. Such lowering or raising of the antenna can be compensated for by extending or retracting the extendable section if required.

Being able to displace the centre of gravity has the exemplary effect that the balance of the antenna arrangement comprising the antenna system can be improved. If the antenna arrangement comprising the antenna system is positioned to be longitudinally or laterally leaning, by rotation of the antenna system and by folding of the mast and/or antenna the centre of gravity can be displaced to counteract forces acting on the antenna arrangement due to the leaning positioning. Thereby outriggers may not always have to be used and the construction of the antenna system may not have to be as heavy, robust and rigid.

According to aspects of the disclosure the extendable section comprises a second pivot joint, whereby the antenna is foldable in relation to at least a part of the extendable section in a plane parallel to the longitudinal direction of the antenna and to the longitudinal direction of the extendable section.

According to yet aspects of the present disclosure the second pivot joint is arranged between an upper end of the extendable section and the antenna. Thereby the second pivot joint connects the antenna to the extendable section. Thereby the antenna is foldable in relation to the extendable section in the vertical plane, i.e. is foldable in a plane parallel to the longitudinal direction of the antenna and to the longitudinal direction of the extendable section, by means of the second pivot joint. Such aspects have the exemplary effect that, assembly of the antenna system is facilitated, the telescopic functionality of the antenna system is not affected and, as will be discussed more in detail below, such aspects provide a suitable arrangement when the antenna system is undeployed, stored, and/or encapsulated before transportation.

According to other aspects of the present disclosure the second pivot joint is arranged somewhere between the upper end of the extendable section and the lower end of the extendable section. Thereby a part, also referred to as upper extendable section, of the extendable section connected to the antenna, and a part, also referred to lower extendable section, of the extendable section not connected to the antenna, are formed. The part of the extendable section connected to the antenna and a part of the extendable section not connected to the antenna are separated by the second pivot joint. Thus, the part of the extendable section connected to the antenna is, except for being connected to the antenna, also connected to the second pivot joint. The part of the extendable section not connected to the antenna is connected to the second pivot joint and to the first pivot joint. By means of the second pivot joint the part of the extendable section connected to the antenna is foldable in relation to the part of the extendable section not connected to the antenna in the vertical plane, i.e. in a plane essentially parallel to the longitudinal direction of the extendable section. Further, for such aspects of the disclosure the telescopic functionality may be divided in two; an upper telescopic functionality and a lower telescopic functionality. However, the basic principle of the functionality is still the same and herein even if the telescopic functionality is divided in two it will simply be referred to as telescopic functionality. Where along the extension in longitudinal direction of the extendable section the second pivot joint is arranged may e.g. be dependent on the specific design on the antenna system and antenna arrangement and the intended use of the antenna system or antenna arrangement.

Having the second pivot joint arranged between an upper end of the extendable section and a lower end of the extendable section has the exemplary effect that for certain antenna system designs an even more compact packaging of the antenna system onto the platform is enabled. Thus, for aspects of the present disclosure having a platform in form of a vehicle and overall even shorter transport may be enabled. For many antenna systems designs the extendable section, often being the longest individual component of the antenna system, is the delimiting factor for how short the transport may be or how compact the antenna system may be packaged.

According to one aspect of the present invention the second pivot joint is arranged essentially in the middle of the extendable section, with respect to the extension in longitudinal direction of the extendable section.

According to yet one aspect of the present invention the second pivot joint is arranged essentially at one third of the length of the extendable section, starting from the upper end of the extendable section.

According to yet an aspect of the disclosure the base section of the mast is arrangeable to the platform such that the mast is rotatable in the horizontal plane. The mast, i.e. the base section of the mast, is preferably arranged to the platform by a rotation means, enabling rotation of the mast in relation to the platform, such as a turntable or similar. This aspect of the present disclosure enables e.g. that the orientation of the foldable mast, thus the orientation or direction in which the mast can be folded, can be controlled.

An exemplary effect of this aspect of the disclosure is that the flexibility and useability of the antenna system is even further improved. In conditions where significant forces are acting on the antenna system and on the platform to which the antenna system is arranged such forces has to be counteracted. This may e.g. be forces due to wind or due to that the platform is positioned in a slope or on an uneven surface, whereby e.g. the force of gravity of the antenna system gives rise to uneven load. To be able to handle such forces prior art antenna systems and platforms to which prior art antenna systems are arranged generally are designed to be heavy, are built using heavy goods and are provided with outriggers.

An exemplary effect of the present disclosure is that it is possibly to, given current location and conditions, displace the centre of gravity of the antenna. By displacing the centre of gravity of the antenna some of the forces acting on the antenna system and on the platform the antenna system is arranged to may be counteracted or compensated for. Thereby it may be possible to design an antenna system, and the platform to which the antenna system is arranged, according to the present disclosure to be less robust, less bulky, not as heavy and possibly even less costly. Less bulky and not as heavy antenna systems means that the flexibility, e.g. in terms of where an antenna system carried by a platform in form of a terrain vehicle can access, is improved. It also means that the operation of the antenna system, such as e.g. deploying and undeploying the antenna system, is less complex, smoother and possibly more rapid.

The addition of the second pivot joint also has the exemplary effect that it enables the antenna system to adopt a nested configuration which is advantageous e.g. when transporting and storing the antenna system. This is further disclosed below and in the detailed description.

According to aspects of the disclosure the extendable section comprises a plurality of telescopic sections wherein the respective innermost telescopic section is configured to slide longitudinally in and out of the respective outermost telescopic section of two adjacent telescopic sections steplessly.

An exemplary effect of being able to control the degree of telescoping steplessly is that this provides maximum control of operational height of the antenna system, within the structural limitations of the antenna system.

According to an aspect of the disclosure the extendable section may adopt any configuration between a fully retracted configuration and a fully deployed configuration. The selected configuration of the extendable section, e.g. the operational height of the antenna system, together with a configuration of respective first and/or second pivot joint, determines the operational configuration of the antenna system. The operational configuration may be selected based on, or dependent on, at least one of the following parameters; current terrain, wind conditions, ground conditions, surrounding vegetation, antenna operating mode—i.e. what is required from the antenna in order to enable that current task is performed, or hostile situation—i.e. if there is an imminent risk that the antenna system may be spotted and attacked by enemy forces.

A further aspect of the disclosure refers to an antenna arrangement, wherein the antenna arrangement comprises an antenna system according to any aspect of the disclosure and a platform. According to one aspect of the disclosure the platform is a vehicle.

The operational height of the antenna system, what also may be referred to as the operational configuration, is, except for the intended use of the antenna system, obviously also determined by constrains of the construction and design of the antenna system.

All herein disclosed aspects of antenna systems can be realised also for an antenna arrangement comprising an antenna system according to any of, or a combination of, aspects of antenna systems disclosed herein, and a platform.

All exemplary effects indicated above for the exemplary aspects of antenna systems obviously apply also for an antenna arrangement comprising an antenna system and a platform. As has been stated above, the exemplary effects of these aspects of the disclosure are in many aspects even more significant if the platform is a vehicle.

According to a first exemplary aspect of the present disclosure the antenna system may adopt an operational height of 9 to 15 meters. This is an improvement in regards to conventional antenna systems and allows the antenna system to better adapt according to e.g. current environmental conditions and terrain with minimized visual signature, but with maintained line of sight.

According to a second exemplary aspect of the present disclosure the antenna system may adopt an operational height of 9 to 20 meters. This is a further improvement in regards to conventional antenna systems and allows the antenna system to, not only, better adapt according to e.g. current environmental conditions and terrain with minimized visual signature, but also enables the antenna system to be positioned even further away with maintained line of sight.

According to a third exemplary aspect of the present disclosure the antenna system may adopt an operational height of 7 to 30 meters. This is a yet further improvement in regards to conventional antenna systems. Such antenna system is even more useable and flexible and may e.g. allow the antenna system to be positioned even further away, possibly where topography otherwise would be a problem, or where the antenna system arranged to a vehicle may have access to an existing road network. As high operational height as possible is desired for improved flexibility, but for maximum flexibility it is also desirable that the antenna system is, if required, capable of operating at low operational height. Being able to operate at low operational height, in combination with high operational height, may e.g. be desirable in urban environment and in surroundings with open fields.

The operational configuration of the antenna system, or of the antenna arrangement, is defined as the operational height, i.e. the current elevation of the antenna, and the rotational speed of the antenna measured in revolutions per minute, RPM. Also other operational parameters may be included in the operational configuration.

The operational configuration, i.e. e.g. the elevation, and the structural properties of the antenna system provide the antenna system, more particularly the mast, a certain natural frequency, also referred to as resonance frequency.

The current environmental conditions, such as e.g. wind, and how the wind affects the antenna given the current RPM of the rotating antenna, results in that the antenna system will be exposed to a certain excitation frequency.

If the natural frequency and the excitation frequency coincide the antenna system enters resonance which may severely degrade the durability and the operability of the antenna system.

The present disclosure also relates to exemplary methods clarifying how any aspect, or a combination of aspects, of an antenna system, or of an antenna arrangement, according to the present disclosure may be operated.

An exemplary aspect of the disclosure refers to a method of avoiding oscillations for an antenna system and/or an antenna arrangement, wherein, given the current operational configuration and the current environmental conditions, the method comprises the method step of;

controlling the operational configuration of the antenna system such that the natural frequency of the mast differs from the excitation frequency.

According to another exemplary aspect of a method of avoiding oscillations for an antenna system and/or an antenna arrangement, wherein a given operational height of the antenna system corresponds to a specific natural frequency of the mast, and a given RPM of the rotating antenna corresponds to a specific excitation frequency given the current environmental conditions, wherein, given the natural frequency of the mast, the method comprises the method step of;

controlling the RPM of the rotating antenna such that the excitation frequency of the mast differs from the natural frequency.

According to yet an exemplary aspect of a method of avoiding oscillations for an antenna system and/or an antenna arrangement, wherein a given operational height of the antenna system corresponds to a specific natural frequency of the mast, and a given RPM of the rotating antenna corresponds to a specific excitation frequency given the current environmental conditions, wherein, given the natural frequency of the mast, the method comprises the method step of;

controlling the operational height of the antenna system such that the excitation frequency of the mast differs from the natural frequency.

By controlling the operational configuration of the antenna system according to any of the exemplary aspects of methods disclosed herein, i.e. either controlling the operational height of the antenna system or the RPM of the rotating antenna, it is possible to avoid that the antenna system enters resonance, whereby e.g. the lifetime of the antenna system may be prolonged.

Yet an exemplary aspect of the disclosure refers to a method of undeploying, storing, packaging or encapsulating before transportation, an antenna arrangement comprising and antenna system and a platform. The platform may be a vehicle having a front end and a rear end defining the extension of the vehicle in longitudinal direction of the vehicle. The antenna has a front surface of the antenna and a back surface of the antenna. The extendable section further comprises a second pivot joint, whereby by means of the second pivot joint the antenna is foldable in relation to at least a part of the extendable section in the vertical plane, wherein the vertical plane is parallel to the longitudinal direction of the antenna and to the longitudinal direction of the extendable section.

The method comprises the method steps of, when the mast is in an at least partially upright and at least partially deployed position;

retracting the extendable section of the mast such that the mast adopts an essentially fully retracted configuration, directing the mast by rotating the mast, by means of rotation means, such that the mast is capable of being folded, by means of the first pivot joint in a direction pointing essentially towards the rear end of the vehicle, rotating the antenna, by means of rotation means, such that the front surface of the antenna is directed in a direction such that when being in a fully nested configuration the front surface of the antenna is directed towards the extendable section of the mast, and folding the extendable section of the mast in relation to the base section of the mast by means of the first pivot joint and folding the antenna in relation to at least a part of the extendable section, by means of the second pivot joint, such that the back surface of the antenna rests against the vehicle, or more particularly against a loading platform of the vehicle, whereby the antenna system is arranged in the fully nested configuration. When in a fully nested configuration the back surface of the antenna preferably abuts the loading platform of the vehicle.

If the antenna of an antenna system is folded in relation to the extendable section or to at least a part of the extendable section is dependent on where the second pivot joint is arranged for that particular antenna system. This will be explained more in detail below. Preferably the rotation of the mast, such that the mast is foldable in a direction pointing essentially towards the end of the vehicle, and the rotation of the antenna, such that that the front surface of the antenna is directed in a direction such that when being in a fully nested configuration the front surface of the antenna is directed towards the mast, is performed when the antenna is in a fully deployed and upright configuration, a fully retracted, but still upright, configuration, or in any configuration there between. If so, the rotation of the mast and of the antenna can be referred to as being performed around the vertical axis of the mast, which also is referred to as the longitudinal direction of the mast.

As is apparent from the disclosure above, the disclosed method is not limited to the above stated exact order of method steps. The method steps may, unless where logically impossible, be performed in any order and/or simultaneously.

As also is considered to be apparent from the context of the disclosure, when herein referring to that e.g. the longitudinal direction of the antenna is essentially parallel to the longitudinal direction of e.g. the extendable section what is considered is that, given the current design and constructional restraints of an antenna system, it may not be possible to fold the antenna such that the longitudinal direction of the antenna is completely parallel, but to be as parallel as possible, to the longitudinal direction of the extendable section. This is also affected by where the second pivot joint is arranged at the extendable section. This will be disclosed more in detail in the detailed description.

The above method has the exemplary effect that the antenna, more particularly the front surface of the antenna, is protected when being in a nested configuration. The front surface of the antenna will to some extent be protected by the retracted extendable section which, when the antenna system is in a nested configuration, is located over the front surface of the antenna. More importantly, when in a nested position the antenna, more particularly the less sensitive back surface of the antenna, rests against the loading platform of the vehicle. This is not least important during transport. Since the antenna arrangement often operates in more or less difficult terrain, whereby during transport the antenna arrangement is exposed to bumps and bounces, it is advantageous that the back surface of the antenna is secured or at least rests against the loading platform of the vehicle. Thus, the loading platform of the platform is preferably provided with locking means configured to secure the antenna, i.e. the back surface of the antenna, to the loading platform during transport. A further exemplary effect of the method is that when the antenna system of the antenna arrangement is undeployed, stored or encapsulated according to the disclosed method the antenna arrangement becomes compactly packaged. This in turn has the exemplary effect that during transport the risk of getting stuck in surrounding vegetation is minimized. Applying the above method of undeploying, storing, packaging and/or encapsulating before transportation, an antenna system of an antenna arrangement further has the exemplary effect when the platform is in form of a vehicle that the total length of the platform is reduced. The above method is further explained in the detailed description.

It is also possible to realize the method for other platforms than for a platform being a vehicle.

According to one exemplary aspect, the present disclosure relates to an antenna system comprising a mast, wherein the mast comprises a base section and an extendable section, wherein the base section is configured to be arrangeable to a platform, and an antenna, wherein the antenna is arranged to be connected to the extendable section and to be rotatable in a plane essentially perpendicular to a longitudinal direction of the antenna, and wherein the extendable section comprises a plurality of telescopic sections, whereby the extendable section may adopt a retracted configuration and a deployed configuration, and wherein the base section is arranged to the extendable section by means of a first pivot joint, whereby the extendable section is foldable in relation to the base section in a vertical plane parallel to the longitudinal direction of the extendable section and to the longitudinal direction of the base section by means of the first pivot joint.

According to another exemplary aspect, the present disclosure relates an antenna arrangement comprising a platform in form of a vehicle, a mast, wherein the mast comprises a base section and an extendable section, wherein an upper end of the base section is arranged to a lower end of the extendable section, and wherein a lower end of the base section is configured to be arrangeable to the vehicle, and an antenna, wherein the antenna is arranged in connection to an upper end of the extendable section, and wherein the extendable section comprises a plurality of telescopic sections, whereby the extendable section may adopt a retracted configuration and a deployed configuration, the base section is arranged to the extendable section by means of a first pivot joint, whereby the extendable section is foldable in relation to the base section in a vertical plane parallel to the longitudinal direction of the extendable section and to the longitudinal direction of the base section by means of the first pivot joint, and the antenna is arranged in connection to the upper end of the extendable section by means of a second pivot joint.

BRIEF DESCRIPTION OF THE FIGURES

With reference to the appended drawings, below follows a more detailed description of exemplary embodiments of the present disclosure.

DETAILED DESCRIPTION OF VARIOUS EMBODIMENTS

The following description of exemplary embodiments of the present disclosure is presented only for purposes of illustration and should not be seen as limiting. The description is not intended to be exhaustive and modifications and variations are possible in the light of the above teachings, or may be acquired from practice of various alternative embodiments of the present disclosure. The examples discussed herein were chosen and described in order to explain the principles and the nature of various example embodiments and its practical application to enable one skilled in the art to utilize the exemplary embodiments in various manners, and with various modifications, as are suited to the particular use contemplated. It should be appreciated that the aspects presented herein separately may be practiced in any combination with each other unless otherwise explicitly is stated.

Reoccurring reference signs refer to corresponding elements throughout the detailed description. When herein using reference signs indexed with a letter what is referred to is an exemplary embodiment of a feature that may be configured differently according to the present disclosure.

For clarification purpose XYZ coordinate systems are indicated in many of the herein disclosed figures. Such coordinate systems are used as reference in order to clearly describe relative positioning, movements and operations of exemplary antenna systems.

Figure 1A:
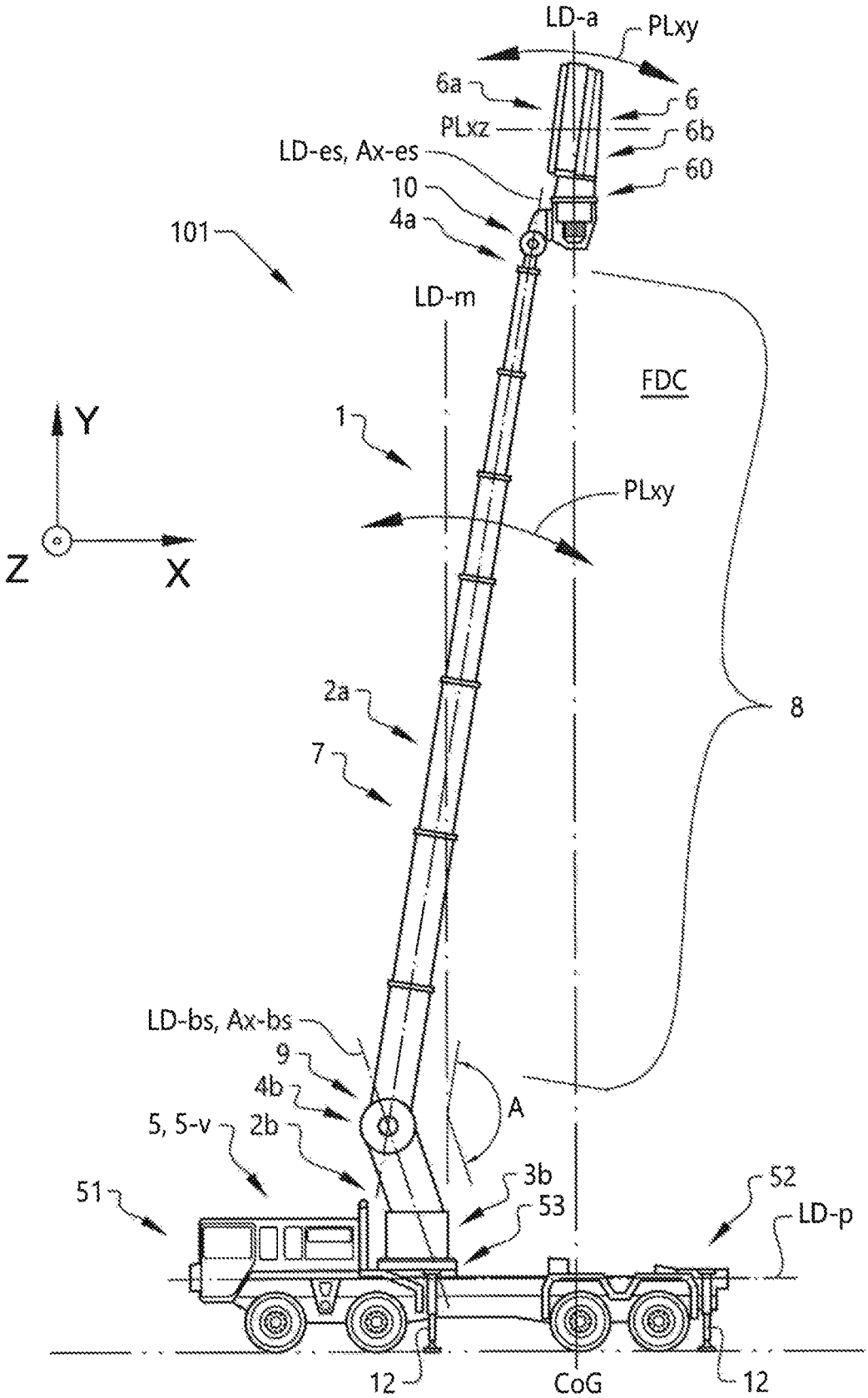
FIG. 1*a* shows a side view of an example of an antenna system according to the present disclosure.

FIG. 1*a* shows an example of an antenna arrangement 101, comprising an antenna system 1 and a platform 5, wherein the platform is in form of a vehicle 5-*v*, in a fully deployed configuration FDC. The antenna system 1 comprises a mast 7, wherein the mast 7 comprises a base section 2*b* and an extendable section 2*a*. An upper end 3*a* of the base section 2*b* is arranged to a lower end 4*b* of the extendable section 2*a*, and a lower end 3*b* of the base section 2*b* is arranged to the platform 5. An upper end 4*a* of the extendable section 2*a* is arranged to be connected to an antenna 6.

The extendable section 2*a* comprises a plurality of telescopic sections 8. The extendable section 2*a* may adopt a fully retracted configuration FRC, a fully deployed configuration FDC, as is shown in FIG. 1*a*, or any configuration there between.

The platform, in FIG. 1*a* in form of a vehicle 5-*v*, has a front end 51 and a rear end 52 defining the longitudinal extension of the vehicle 5-*v*, i.e. the platform 5, in longitudinal direction of the platform LD-p, which according to the coordinate system of FIG. 1*a* is directed in X direction. The platform 5 also has a transverse extension, not shown, which according to the coordinate system of FIG. 1*a* is directed in Z direction. The longitudinal direction of the platform LD-p, in X direction, and the transverse extension of the platform, in Z direction, defines a horizontal plane PLxz.

When the mast 7 is in an upright position, as in the example shown in FIG. 1*a*, a longitudinal direction of the mast LD-m is defined as being perpendicular to the horizontal plane PLxz, i.e. perpendicular to as well the longitudinal direction of the platform LD-p as the transverse direction of the platform. Further, according to the example shown in FIG. 1*a*, when the mast 7 is in an upright position the longitudinal direction of the extendable section LD-es is arranged with an angle A in relation to a longitudinal direction of the base section LD-bs. This may also be explained as that an axis (Ax-bs) extending in the longitudinal direction of the base section LD-bs and an axis Ax-es extending in the longitudinal direction of the extendable section LD-es is arranged with an angle A in relation to one another.

As is shown in FIG. 1*a* the centre of gravity CoG is, due to that the extendable section 2*a* is arranged at the angle A in relation to the base section 2*b*, positioned offset in relation to the attachment point were the lower end 3*b* of the base section 2*b* is arranged to the platform 5. By offsetting, or displacing, the centre of gravity CoG of the antenna 6 in relation to the attachment point of the mast 7, the mast 7 will always be exposed to a load generated by the weight of the antenna 6. This has the exemplary effect of clearance minimization of the antenna system 1. By applying a constant load on the mast 7 play between interacting components will be eliminated or reduced whereby the construction will be more rigid. A rigid construction, with minimized movements due to e.g. play improves durability and performance of the antenna system 1. This is particularly important for the present disclosure since the telescopic functionality of the antenna system 1 provides a large number of interacting components due to the plurality of telescopic sections 8, thereby a large number of clearances and tolerances.

As is apparent from the disclosure, the example of an antenna arrangement 101, comprising an antenna system 1 and a platform 5 in form of a vehicle 5-*v*, shown in FIG. 1*a* is just one possible realization according to the present disclosure. The design and configuration of e.g. the bases section 2*b*, the extendable section 2*a*, the angle A etc. are dependent on e.g. constructional restraints and intended use of the antenna arrangement. The offset of the centre of gravity CoG in relation to the attachment point is e.g. dependent on the angle A and the degree of extension of the extendable section 2*a* of respective antenna system design.

Thus, it is considered to be apparent for a person skilled in the art that various realizations of the mast due to constructional restraints or constructional design features all are within the scope of the present disclosure. The slight tilt of the extendable section 2*a* in relation to the base section 2*b* in example of an antenna system 1 in FIG. 1 is considered to be an example of such a constructional design feature.

The vehicle 5-*v* further comprises a loading platform 50 configured to receive and hold cargo or similar.

In FIG. 1*a* a longitudinal direction of the antenna LD-a coincides with the longitudinal direction of the mast LD-m. The antenna 6 has a front surface of the antenna 6*a* and a back surface of the antenna 6*b*, wherein the front surface of the antenna 6*a* is directed in the opposite direction as the back surface of the antenna 6*b*. The antenna 6 is arranged to be rotatable in a plane PLxz essentially perpendicular to a longitudinal direction of the antenna LD-a, i.e. in the horizontal plane PLxz, by means of a turntable 60, or other similar rotation means enabling rotation of the antenna 6 in relation to the extendable section 2*a*. The base section 2*b* is arranged to the platform 5 by a rotation means 53, such as e.g. a turntable, enabling the antenna system 1 to be rotatable in the horizontal plane PLxz.

The upper end 3*a* of the base section 2*b* is connected to the lower end 4*b* of the extendable section 2*a* by means of a first pivot joint 9. By means of the first pivot joint 9 the mast 7 is foldable. According to the example disclosed in FIG. 1*a* the mast 7 is foldable in a vertical plane PLxy which is parallel to the longitudinal direction of the extendable section LD-es as well as to the longitudinal direction of the base section LD-bs. The vertical plane PLxy is perpendicular to the horizontal plane PLxz.

In FIG. 1*a* the upper end 4*a* of the extendable section 2*a* is further arranged to the antenna 6 by means of a second pivot joint 10, whereby the antenna 6 also is foldable in, according to the example of FIG. 1*a*, the vertical plane PLxy, which id parallel to the longitudinal direction of the extendable section LD-es and to the longitudinal direction of the base section LD-b, i.e. the antenna 6 is foldable in the vertical plane PLxy by means of the second pivot joint 10.

The vehicle 5-*v* is further provided with outriggers 12. The outriggers 12 provide additional support to the vehicle 5-*v* when required.

Figure 1B:
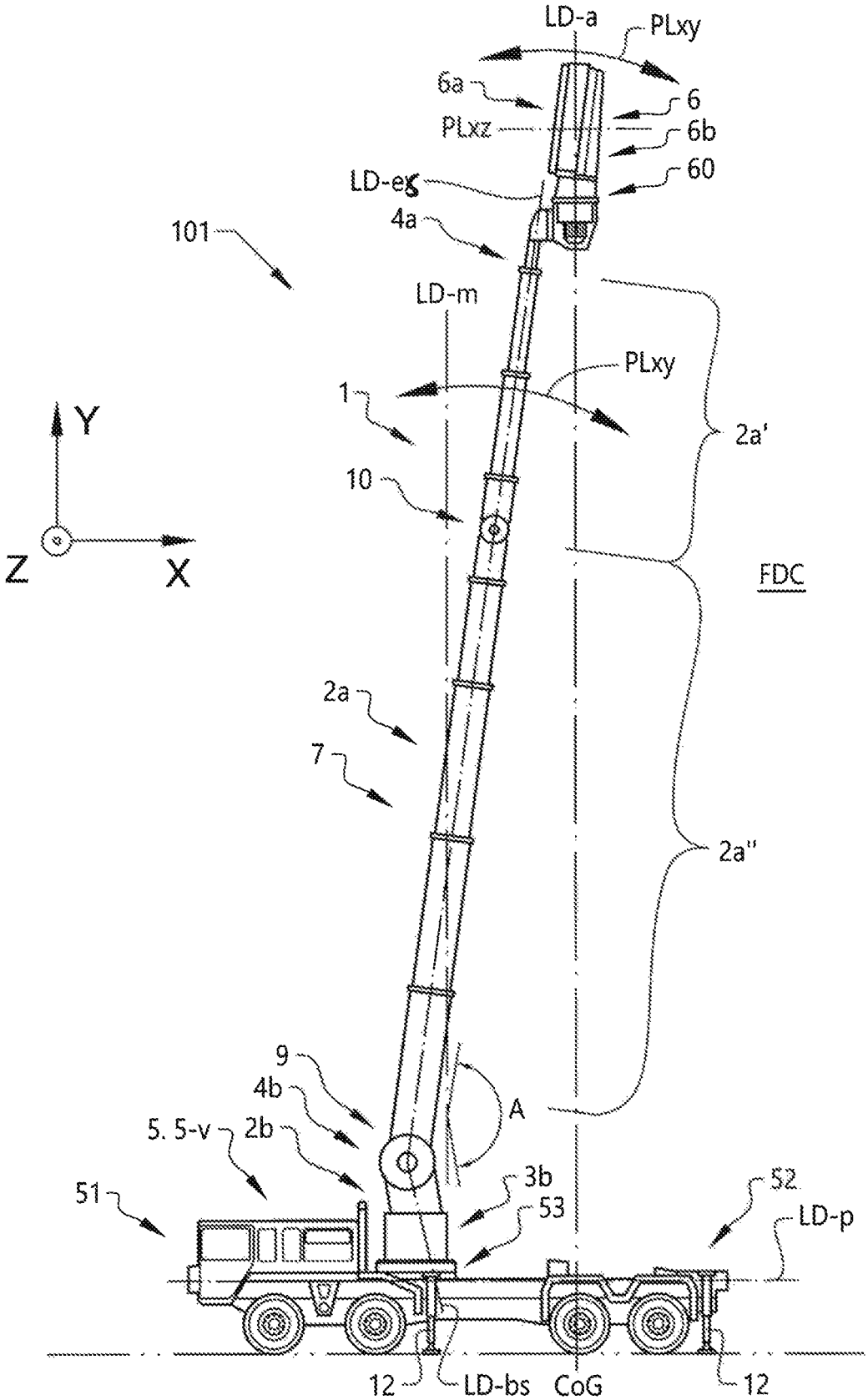
FIG. 1*b* shows a side view of another example of an antenna system according to the present disclosure.

FIG. 1*b* discloses yet an example of an antenna system 1, of an antenna arrangement 101, according to the present disclosure. For the antenna system 1 disclosed in FIG. 1*b* the second pivot joint 10 is not arranged between the antenna 6 and the upper end 4*a* of the extendable section 2*a* but between the upper end 4*a* of the extendable section 2*a* and a lower end 4*b* of the extendable section 2*a*. Thereby an upper extendable section 2*a*' of the extendable section 2*a*, connected to the antenna 6, and a lower extendable section 2*a*" of the extendable section 2*a*, not connected to the antenna 6, is formed. The upper and lower extendable sections 2*a*', 2*a*" are separated by the second pivot joint 10. The upper extendable section 2*a*' of the extendable section 2*a* connected to the antenna 6 is, except for being connected to the antenna 6, also connected to the second pivot joint 10. The lower extendable section 2*a*" of the extendable section 2*a*, which is not connected to the antenna 6, is connected to the second pivot joint 10 and the first pivot joint 9.

By means of the second pivot joint 10 the upper extendable section 2*a*' of the extendable section 2*a* is foldable in relation to the lower extendable section 2*a*" of the extendable section 2*a* in the vertical plane PLxy, thus in a plane parallel to the longitudinal direction of the extendable section LD-es and to the longitudinal direction of the base section LD-bs. Further, the telescopic functionality of the exemplary disclosure of FIG. 1*b* is divided in two; the upper extendable section 2*a*' of the extendable section 2*b* providing one telescopic functionality and the lower extendable section 2*a*" of the extendable section 2*b* providing one telescopic functionality. The telescopic functionalities of the upper and lower extendable sections 2*a*', 2*a*" work in the same way as any other herein disclosed telescopic functionality. However, having an upper telescopic functionality provided by the upper extendable section 2*a*' and a lower telescopic functionality provided by the lower extendable section 2*a*" has the exemplary effect that it is possible to design and configure respective telescopic functionality differently. It is e.g. possible to have different numbers of telescopic sections in respective extendable section 2*a*', 2*a*" or by having differently configured telescopic sections, e.g. in terms of longitudinal extension, in respective extendable section 2*a*', 2*a*".

Where along the extension in longitudinal direction of the extendable section LD-es the second pivot joint 10 is arranged may e.g. be dependent on the specific design on the antenna system 1 and antenna arrangement 101 and the intended use of the antenna system 1 or antenna arrangement 101.

Figure 2A:
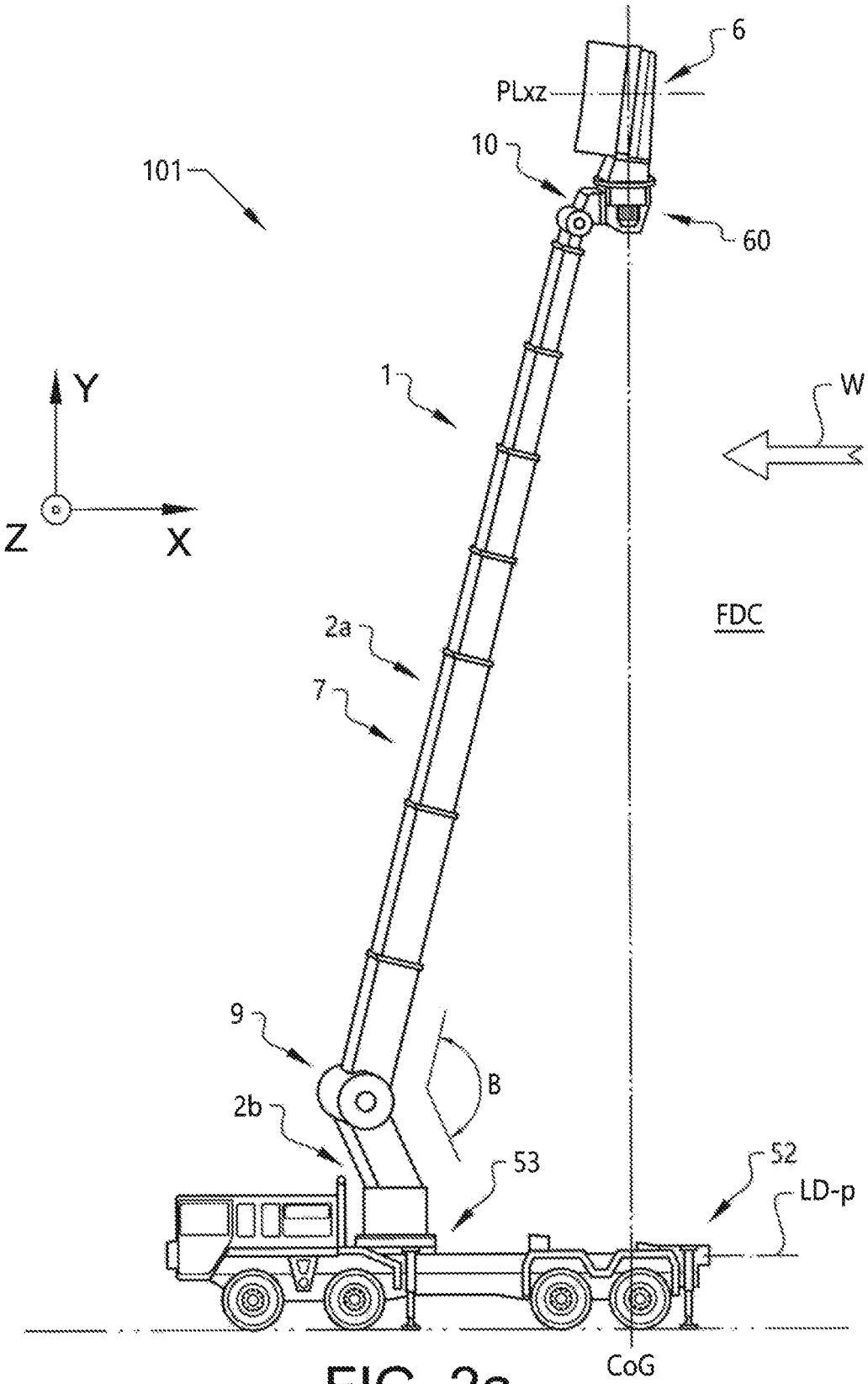
FIG. 2*a* shows a side view of an example of an antenna system in a deployed configuration for which the centre of gravity of an antenna has been shifted.

FIG. 2*a* shows another example of an antenna arrangement 101, comprising an antenna system 1 and a platform 5. Also, in FIG. 2*a* the platform 2 is in form of a vehicle 5-*v*, and the antenna system 1 is in a fully deployed configuration FDC.

Figure 2B:
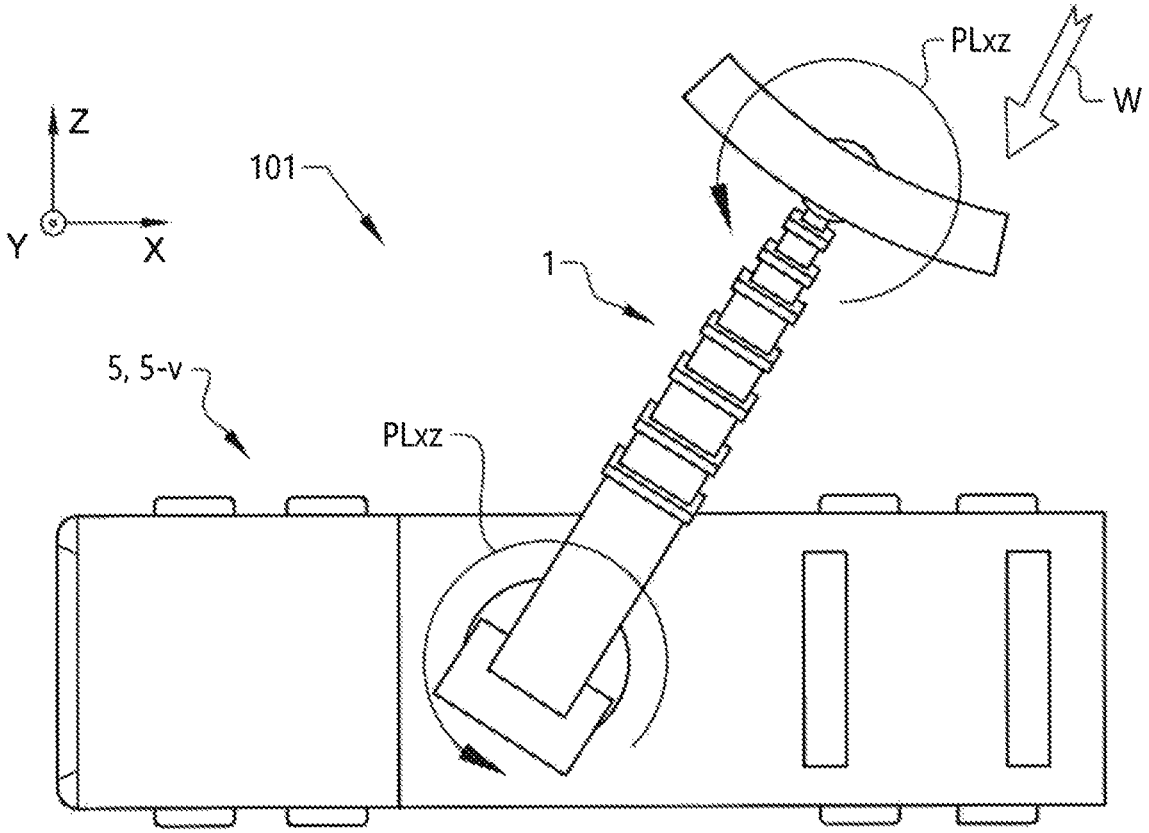
FIG. 2*b* shows a top view of an example of an antenna system in a deployed configuration for which the centre of gravity of an antenna has been shifted.

FIG. 2*b* shows the same antenna arrangement 101 from a top view.

In FIG. 2*a* and FIG. 2*b* the antenna system 1 is exposed to a stationary wind, indicated by an arrow W, which acts on the antenna system 1 with a force. The force with which the wind W acts on the antenna system 1 may vary with e.g. rotation of the antenna 6. The rotation of the antenna may e.g. be enabled by means of a turntable 60.

In the example shown in FIGS. 2*a* and 2*b* the antenna system 1 is partly rotated by means of the rotation means 53. The extendable section 2*a* is also slightly tilted in relation to the base section 2*b* with an angle B. By rotating and tilting the antenna system 1 and the extendable section 2*a* the centre of gravity CoG of the antenna 6 is displaced. Displacing the centre of gravity CoG of the antenna 6 has the exemplary effect that forces due to e.g. a more or less stationary wind W may be at least partially counteracted. As will be shown and discussed in relation to FIGS. 4*a* to 4*c*, being able to displace or shift the CoG is also advantageous if the antenna arrangement is positioned in e.g. a slope, whereby the platform leans longitudinally, or even more advantageous if the antenna arrangement is positioned such that the vehicle leans laterally.

According to the present disclosure this functionality, which is enabled by that the antenna system 1 is provided with; capability of rotating the antenna system 1, capability of being extendable, by means of the extendable section 2*a*, and capability of being foldable, by means of the first and second pivot joints 9, 10, significantly improves the operability and flexibility of the antenna system 1. It enables that forces acting on the antenna system 1 may be counteracted by adapting the antenna system 1 according to prevailing conditions, such as the exemplary windy conditions shown in FIG. 2*a* and FIG. 2*b*. Thereby the antenna system 1, and the antenna arrangement 101 comprising the antenna system 1, may compensate for external forces acting on the antenna arrangement 101, comprising the antenna system 1. This in turn e.g. has the effect that an antenna arrangement 101, comprising an antenna system 1, can be designed and constructed by using lighter and not as thick and heavy goods.

An antenna system as shown in e.g. FIG. 1*a*, FIG. 1*b*, FIG. 2*a* and FIG. 2*b* also has the exemplary advantage, especially when being arranged to a vehicle, that improved operational capability is combined with high mobility.

The combination of being foldable and having telescopic functionality gives an antenna system according to the present disclosure exemplary advantages such as being far more adaptable than conventional transportable antenna system in terms of e.g. direction and/or position in relation to the platform of the antenna system. Thereby the operational freedom and performance of the antenna system is improved.

These exemplary advantages in combination with, for vehicle based applications, improved mobility due to being arranged to a vehicle, and a lighter and less bulky construction than of conventional mobile antenna systems enables an antenna system and an antenna arrangement according to the present disclosure to be far more adaptable to prevailing conditions than conventional systems. First of all the operational height is improved but also e.g. the capability to move in though terrain is improved.

Thus, an antenna system according to the present disclosure has important advantages over both conventional mobile antenna systems and over conventional transportable antenna systems.

Figure 3:
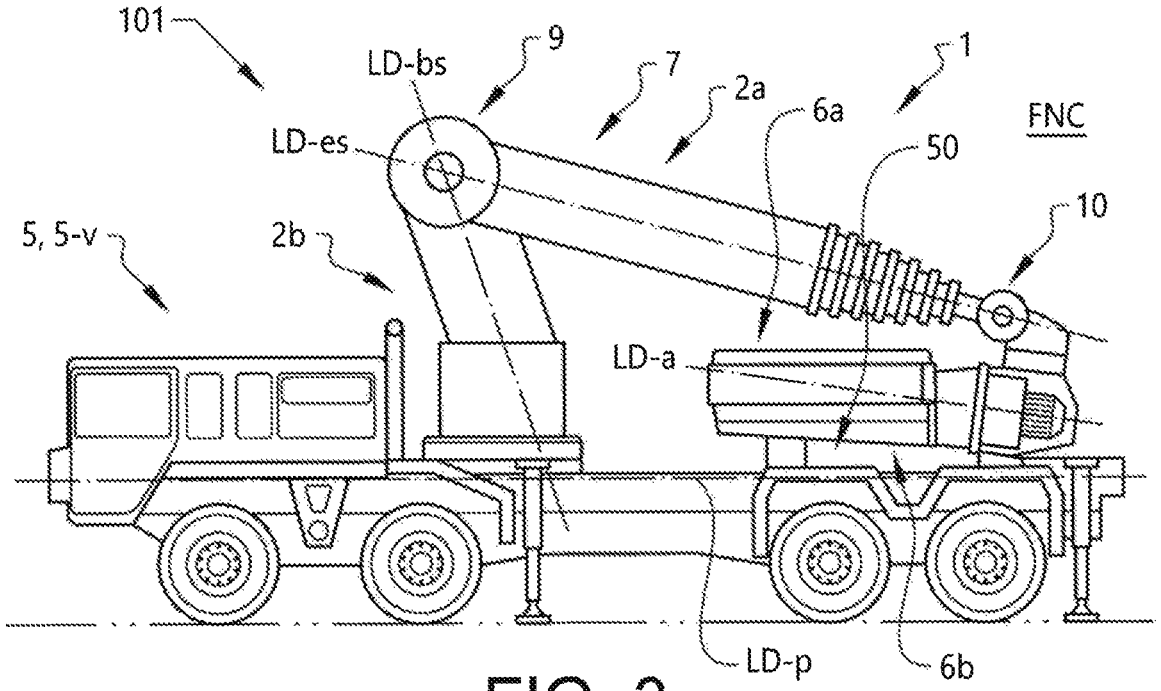
FIG. 3 shows an example of an antenna system according to the present disclosure in a nested configuration.

FIG. 3 shows an example of an antenna arrangement 101, comprising an antenna system 1 and a platform 5, also in FIG. 3 in form of a vehicle 5-*v*, wherein the antenna system 1 is in a fully nested configuration FNC. According to the example shown in FIG. 3, when the antenna system 1 is in a fully nested configuration FNC the extendable section 2*a* of the mast 7 is folded, by means of the first pivot joint 9, such that the longitudinal direction of the extendable section LD-es is nearly parallel to the longitudinal direction of the platform LD-p, or at least as parallel as possible given the current antenna system design. The antenna 6 is folded, by means of the second pivot joint 10, such that a longitudinal direction of the antenna LD-a also is nearly parallel to the longitudinal direction of the platform LD-p, or at least as parallel as possible given the current antenna system design, and to the longitudinal direction of the extendable section LD-es. Thereby the extendable section 2*a* is folded to be positioned above the antenna 6.

The vehicle 5-*v* further comprises a loading platform 50 configured to receive and hold cargo or similar. As is disclosed in the example of the antenna system 1 of FIG. 3, when in a fully nested configuration FNC the back side on the antenna 6*b* is positioned to rest on the loading platform 50 of the vehicle 5-*v*. Thereby the front surface of the antenna 6*a*, which is directed in the opposite direction as the back surface of the antenna 6*b*, is directed towards the extendable section 2*a* of the mast 7. Thus, an exemplary advantage with the antenna arrangement 101, comprising the antenna system 1, according to the present disclosure is that when being configured in the fully nested configuration FNC the extendable section 2*a*, provides protection for the front surface of the antenna 6*a* by being positioned above the front surface of the antenna 6*b*. Yet an exemplary advantage with the antenna arrangement 101, comprising the antenna system 1, according to the present disclosure is that since the back surface of the antenna 6*b* may be positioned to abut the loading platform 50 of the vehicle 5-*v* movements of the antenna 6 during e.g. transport can be counteracted. The back surface of the antenna 6*b* is preferably locked in position by a locking means (not shown) at the loading platform 50 in order to minimize movements of the antenna 6 during e.g. transport. For further dampening of movements of the antenna 6, and to further counteract that the antenna 6 is shaken during transport, the loading platform may also be provided with resilient shock absorbers, cushioning or similar (not shown). Even if not shown, also for most realizations of antenna systems for which the second pivot joint is arranged between the upper end and the lower end of the extendable section it is possible to arranged the antenna system in a fully nested configuration.

Figure 4A:
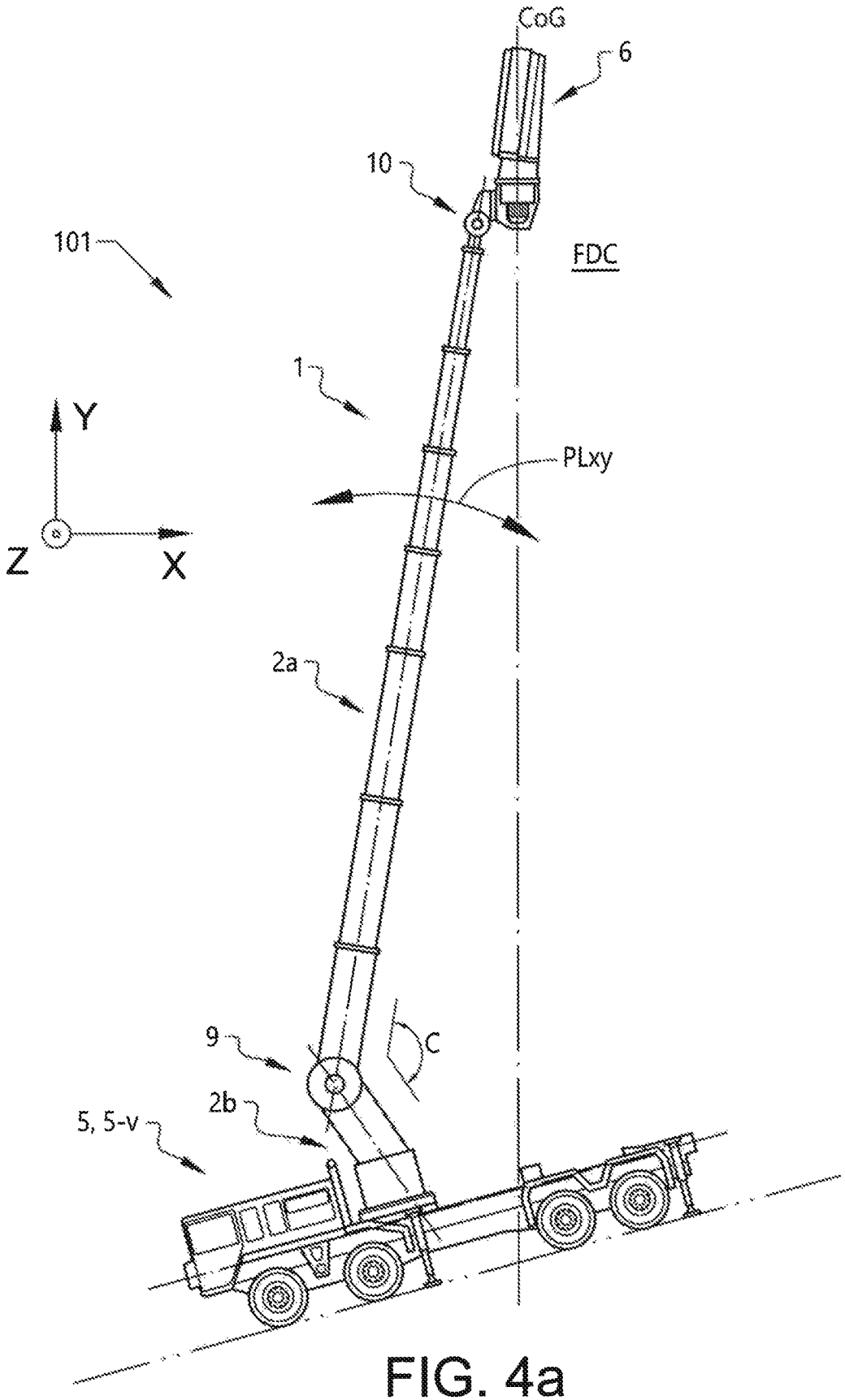
FIG. 4*a* shows an example of an antenna arrangement leaning longitudinally.

FIG. 4*a* shows an example of an antenna arrangement 101, comprising an antenna system 1 and a platform 5, in FIG. 4*a* in form of a vehicle 5-*v*, in a fully deployed configuration FDC. The vehicle 5-*v* is positioned in a slope, whereby the vehicle 5-*v* leans in longitudinal direction. In order to counteract excessive or uneven load of an antenna system 1 according to the present disclosure the antenna system 1 is configured such that the centre of gravity CoG of the antenna 6 may be shifted. The centre of gravity CoG can be displaced without having to affect e.g. the operational height and/or the positioning of the antenna 6. Such displacement of the centre of gravity CoG, without affecting e.g. the operational height and/or the positioning of the antenna 6, is enabled by means of the combination of the antenna mast 7 and the antenna 6 being foldable, by means of the first and second pivot joints 9, 10, and that the extendable section 2*a* provides telescopic functionality. In FIG. 4*a* the extendable section 2*a* is folded, by means of the first pivot joint 9, an angle C in relation to the base section 2*b*, in the vertical plane PLxy.

By displacing the centre of gravity CoG of the antenna 6 the balance of the antenna system 1 and antenna arrangement 101 can be improved. If the antenna arrangement 101 comprising the antenna system 1 is positioned to lean longitudinally or laterally, by rotation of the antenna system 1 and/or folding of the mast 7 and/or antenna 6 the centre of gravity CoG may be displaced, whereby excessive stress the antenna system 1 is exposed to may be reduced. Thereby e.g. outriggers 12 may not always have to be used and the construction of the antenna system 1 and antenna arrangement 12 may not have to be as heavy and rigid.

This has the exemplary effect that it is possible to design an antenna system, and the platform to which the antenna system is arranged, to be less robust, less bulky, not as heavy and possibly even less costly. As previously discussed it is however desirable that the antenna system constantly is exposed to some load for clearance minimization.

Figure 4B:
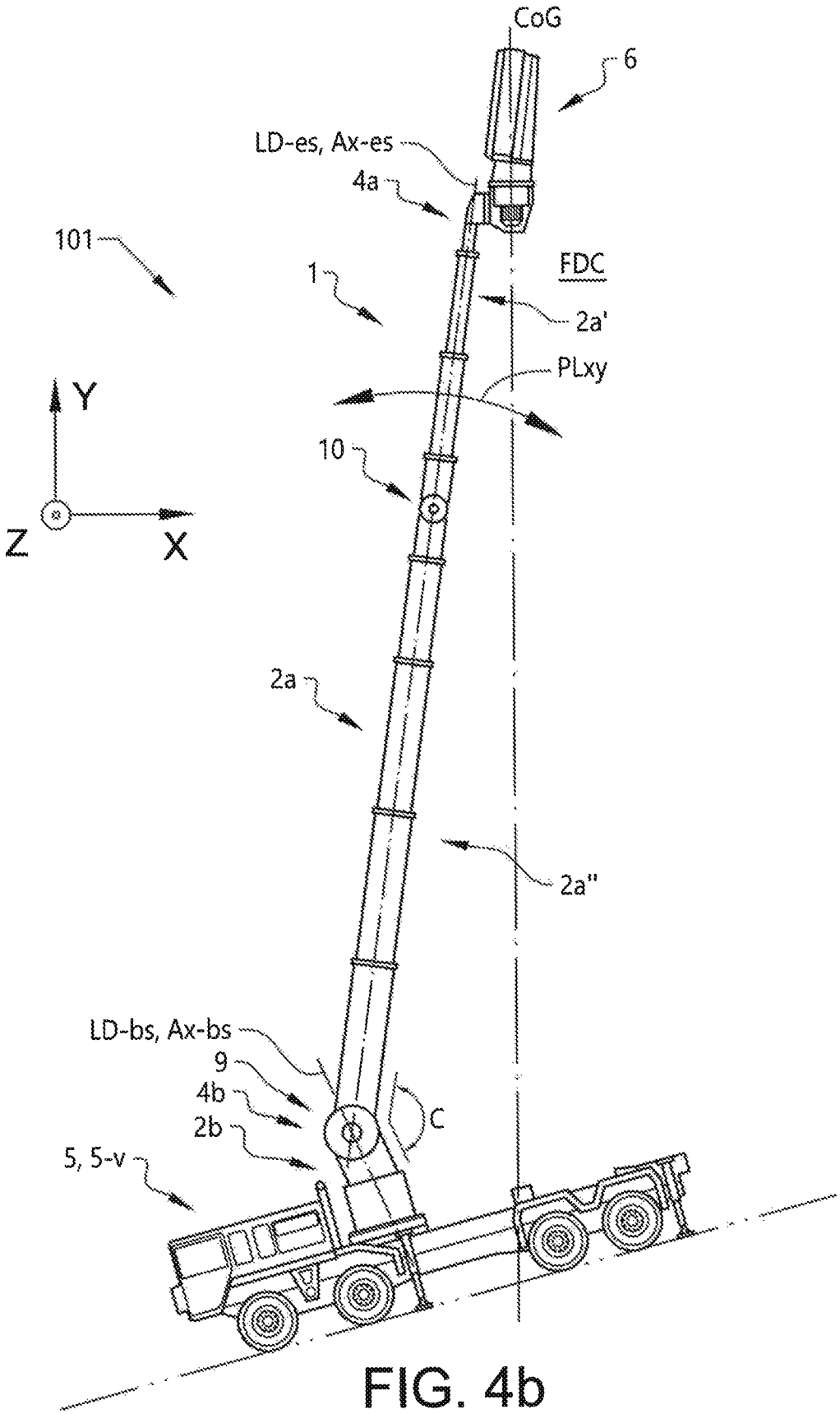
FIG. 4*b* shows another example of an antenna arrangement leaning longitudinally.

FIG. 4*b* shows another example of an antenna arrangement 101 leaning longitudinally. The example of an antenna arrangement 101 of FIG. 4*b* shows an example where the second pivot joint 10 is arranged between the upper end 4*a* and the lower end 4*b* of the extendable section 2*a*. Further, in FIG. 4*b* the part of the extendable section connected to the antenna 2*a*' and a part of the extendable section not connected to the antenna 2*a*" are aligned and both extend essentially in the longitudinal direction of the extendable section LD-es. Also, in FIG. 4*b* the extendable section 2*a* is folded, by means of the first pivot joint 9, an angle C in relation to the base section 2*b*, i.e. an axis Ax-bs extending in the longitudinal direction of the base section LD-bs is arranged at the angle C in relation to an axis Ax-es extending the longitudinal direction of the extendable section LD-es.

Figure 4C:
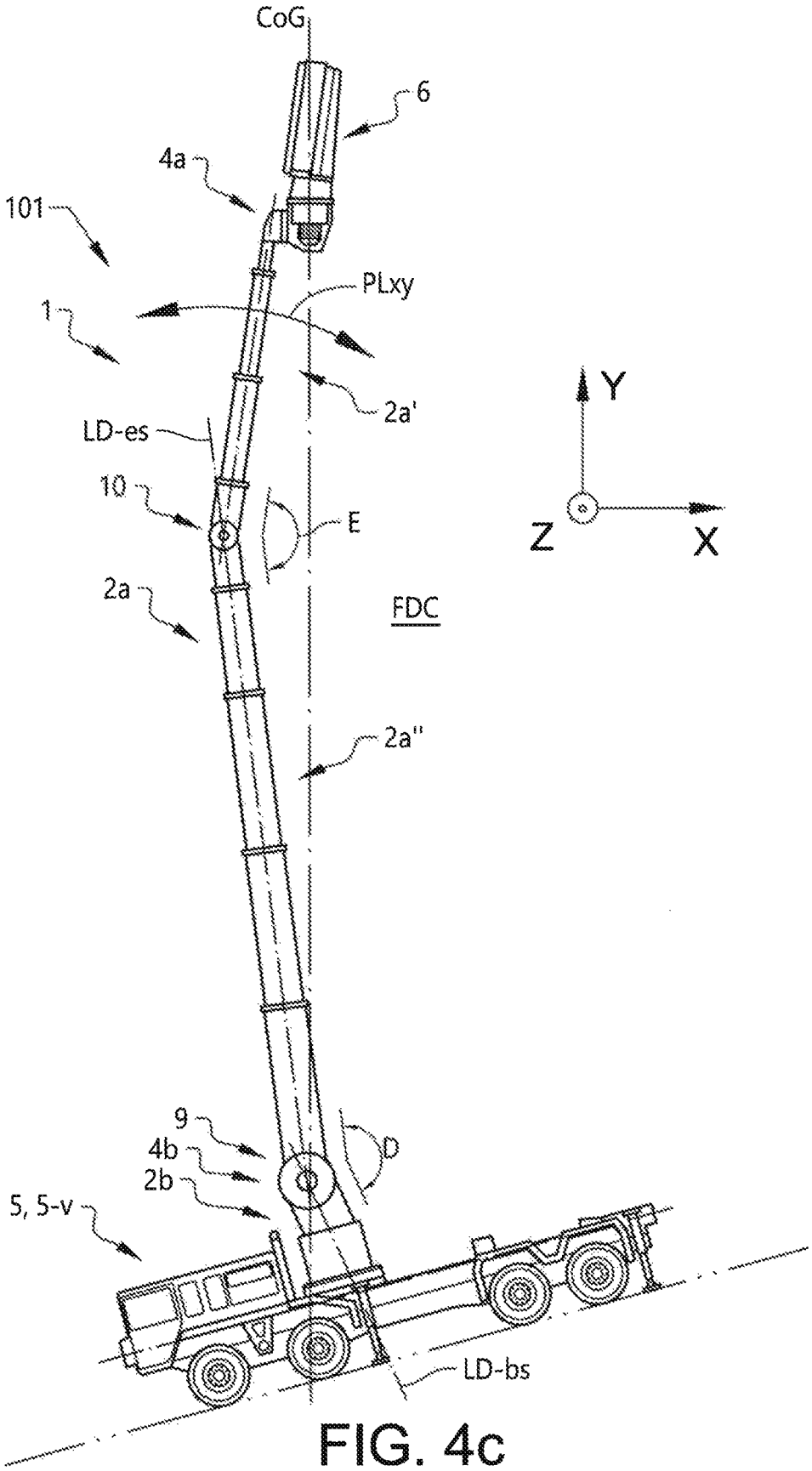
FIG. 4*c* shows yet an example of an antenna arrangement leaning longitudinally.

FIG. 4*c* shows yet an example of an antenna arrangement 101 leaning longitudinally. The example of an antenna arrangement 101 of FIG. 4*c* also shows an example where the second pivot joint 10 is arranged between the upper end 4*a* and the lower end 4*b* of the extendable section 2*a*. In FIG. 4*c* the extendable section 2*a* is folded, by means of the first pivot joint 9, an angle D in relation to the base section 2*b*, in the vertical plane PLxy. In FIG. 4*c* the part of the extendable section connected to the antenna 2*a*' and a part of the extendable section not connected to the antenna 2*a*" are folded in relation to one another with the angle E, in the vertical plane PLxy, by means of the second pivot joint 10.

For examples where the part of the extendable section connected to the antenna 2*a*' and a part of the extendable section not connected to the antenna 2*a*" are folded in relation to one another the longitudinal direction of the extendable section LD-es is defined as the longitudinal direction of the of the part of the extendable section not connected to the antenna 2*a*".

Figure 5:
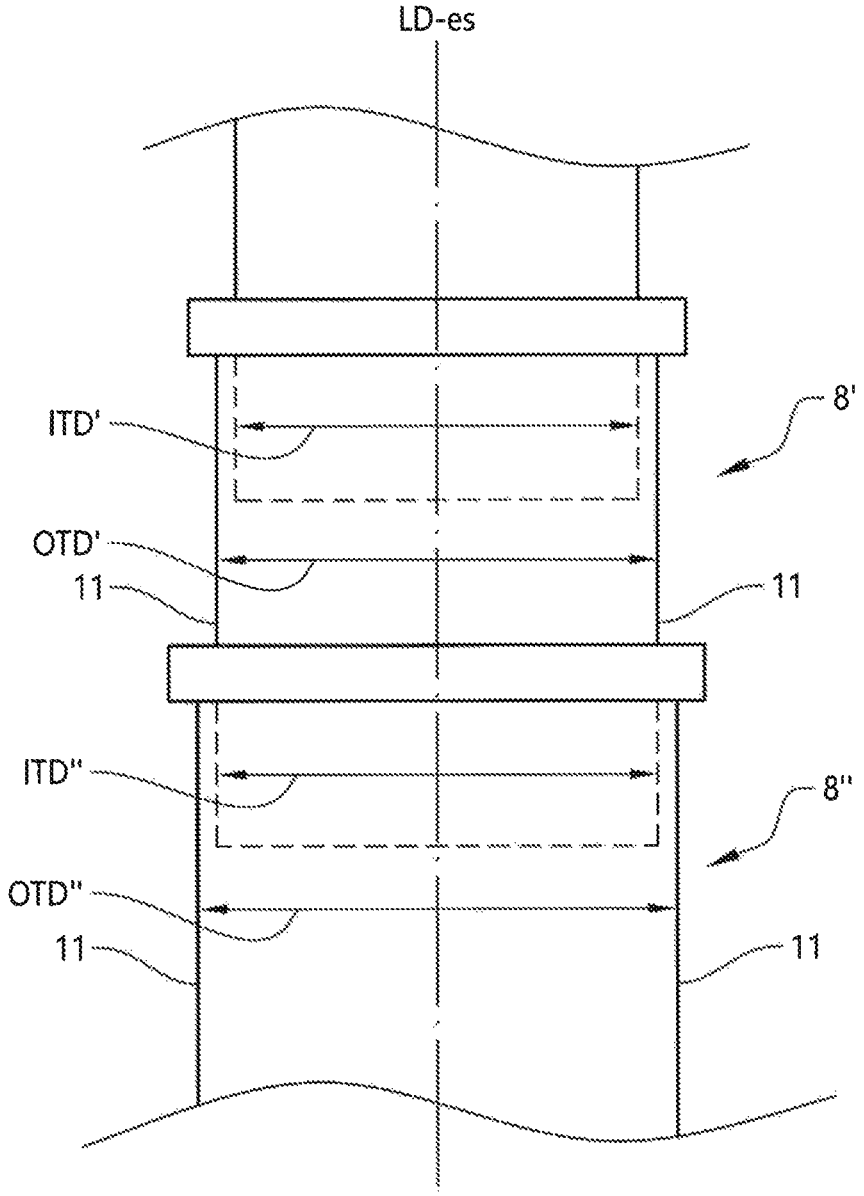
FIG. 5 shows an example how the telescopic functionality may be realised.

As previously disclosed, having the second pivot joint arranged between an upper end of the extendable section and a lower end of the extendable section has the exemplary effect that for certain antenna system designs an even more compact packaging of the antenna system onto the platform is enabled and/or that an overall shorter transport may be obtained. FIG. 5 shows an example of how the telescopic functionality of an antenna system according to the present disclosure may be realised. The extendable section of an antenna system according to the present disclosure comprises a plurality of telescopic sections 8', 8", which also may be described as a plurality of interconnected tubular sections, wherein each tubular section comprises an essentially hollow body.

In FIG. 5 examples of two adjacent telescopic sections 8', 8" are discloses, wherein each telescopic section 8', 8" has walls 11 extending essentially in the longitudinal direction of the extendable section LD-es of the mast, and where the outer transverse dimension OTD' of an innermost telescopic section 8' is smaller than an inner transverse dimension ITD" of an outermost telescopic section 8", such that the innermost telescopic section 8' is capable of sliding in and out of the outermost telescopic section 8" in longitudinal direction.

With transverse dimension is herein referred to the measurement across a telescopic section in a direction perpendicular to the longitudinal direction of the telescopic section. Since the examples of telescopic sections 8', 8" of FIG. 5 are hollow, each telescopic section 8', 8" has an outer transverse dimension and an inner transverse dimension.

This movement of adjacent telescopic sections are also referred to as telescoping functionality. The telescopic sections 8', 8" of the example of an antenna system according to the present disclosure disclosed in FIG. 5 are essentially coaxially aligned. However, it should be emphasized that this is not a requirement for enabling the telescoping functionality.

The longitudinal movements of the telescopic sections, i.e. the telescoping functionality, may be enabled by any of the commonly known means of providing such functionality. This may e.g. include a rack and pinion arrangement, use of a wire winch or use of hydraulics.

A pinion rack arrangement may e.g. be provided by having a pinion drive, aligned with the extension of the telescopic section to which the pinion drive is arranged, and an rack, aligned with the extension of the adjacent extendable section to which the rack is arranged, interact. For a hydraulics arrangement may e.g. an interacting piston and piston barrel be arranged to be aligned with two adjacent extendable sections. Means of realizing the telescopic functionality are not part of the present disclosure per se and will not be further disclosed herein.

Further, according to exemplary aspects of antenna systems according to the present disclosure the telescoping functionality is stepless.

FIG. 6*a* to FIG. 6*d* schematically show how an example of an antenna system 1 arranged to a platform 5 in form of a vehicle 5-*v*, may adopt a fully nested configuration FNC, starting from a fully retracted configuration FRC. FIGS. 6*a* to 6*d*, and the below disclosed method, disclose the basic principle of the method, including the main steps of the method, but minor deviations and additional sub-steps e.g. dependent on specific design characteristics of an antenna system or antenna arrangement, are considered to be within the scope of the present disclosure.

In FIGS. 6*a* to 6*d* an example of an antenna arrangement 101 for which the second pivot joint 10 is arranged between the upper part 4*a* of the extendable section 2*a* and the antenna 6 is shown. However, the method is also applicable for most realizations of antenna arrangements 101 for which the second pivot joint 10 is arranged between the upper end 4*a* and the lower end 4*b* of the extendable section 2*a*.

The vehicle 5-*v* has a longitudinal extension, wherein the vehicle 5-*v* has a front end 51 and a rear end 52 defining the extension of the vehicle 5-*v* in longitudinal direction of the platform LD-p. The vehicle 5-*v* further comprises a loading platform 50 configured to receive and hold cargo or similar. For clarification purpose a XYZ coordinate system is indicated which applies for FIG. 6*a* to FIG. 6*d* and which will be used as reference in order to clearly describe the movements and operations of the exemplary antenna system 1. The antenna 6 has a front surface of the antenna 6*a* and a back surface of the antenna 6*b*, wherein the front surface of the antenna 6*a* is defined as the surface in the direction in which the antenna 6 is configured to be able to transmit and/or receive, and the mechanically less sensitive back surface of the antenna 6*b* is arranged on the opposite side of the antenna 6 as the front surface of the antenna 6*a*.

Figure 6A:
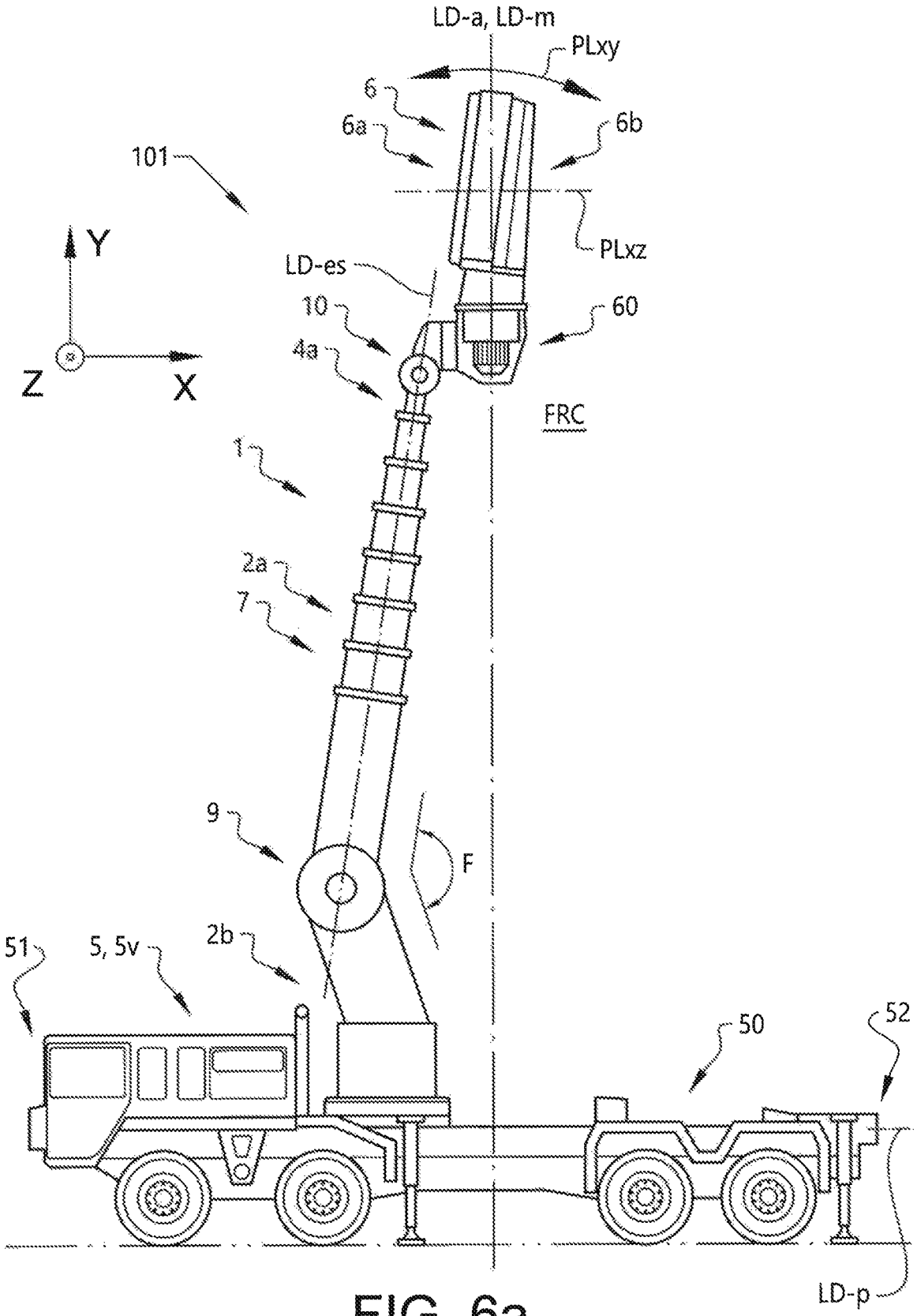
FIG. 6*a* to FIG. 6*d* show how the antenna system may adopt a nested configuration, and FIG. 7 schematically shows a flow chart disclosing an example of a method according to the present disclosure.

In FIG. 6*a* the antenna system 1 is in the fully retracted configuration FRC. The base section 2*b* is arranged to the extendable section 2*a* with an angle F by means of the first pivot joint 9.

Figure 6B:
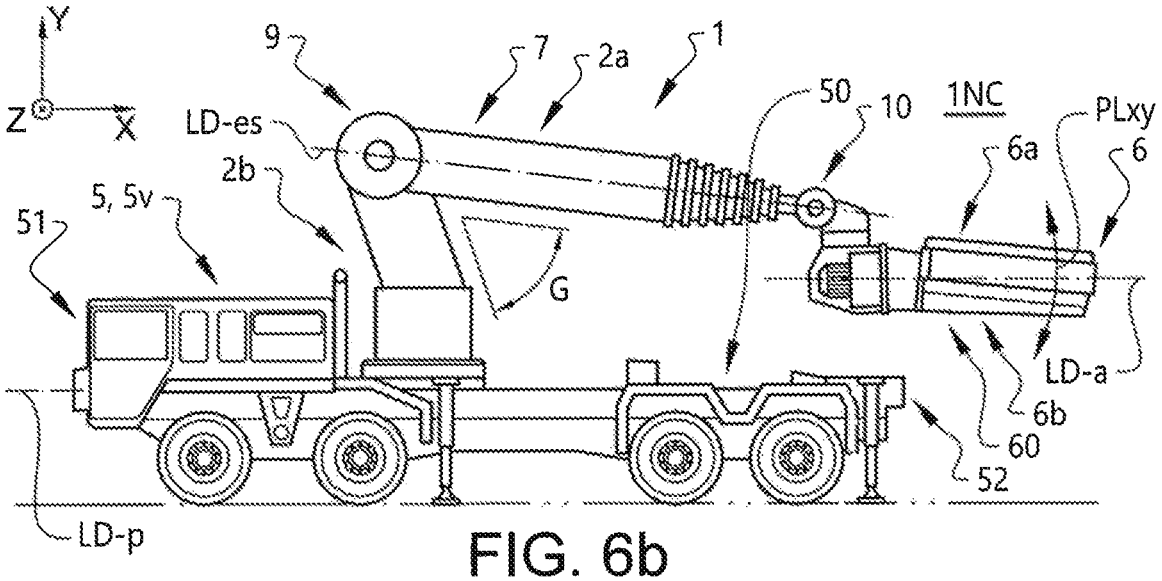

In FIG. 6*b* the antenna system 1 is in a partly nested configuration, referred to as a first nesting configuration 1NC, in which an extendable section 2*a* is folded an angle G, by means of a first pivot joint 9, in relation to the base section 2*b*.

Figure 6C:
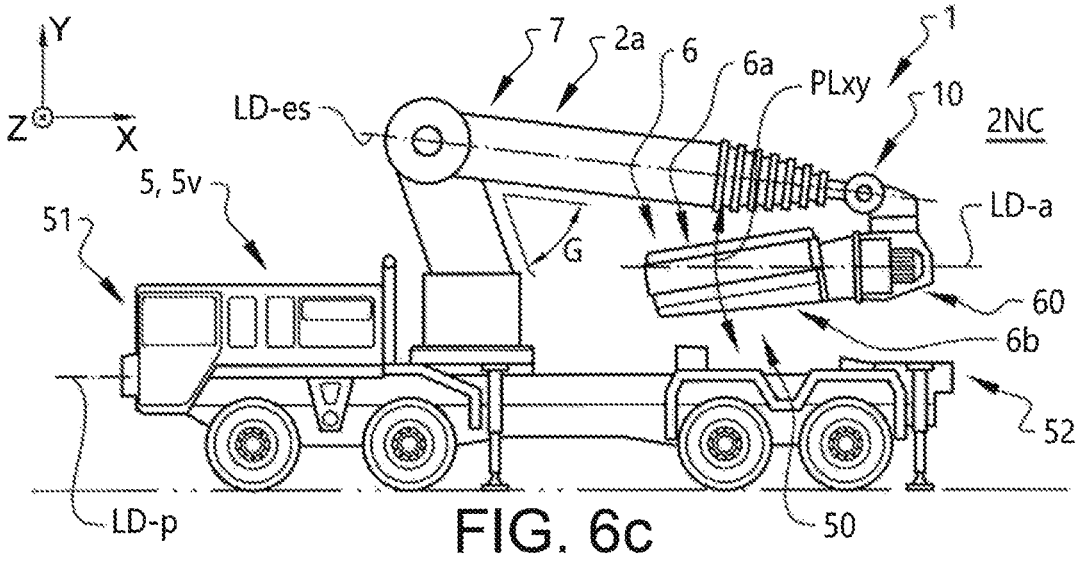

An antenna 6 is arranged to an upper end 4*a* of the extendable section 2*a* to be rotatable in a plane PLxz essentially perpendicular to the longitudinal direction of the antenna LD-a. In FIG. 6*a* the longitudinal direction of the antenna LD-a is essentially perpendicular to the longitudinal direction of the platform LD-p, and coincide with longitudinal direction of the mast LD-m. In FIGS. 6*b* and 6*c* the longitudinal direction of the antenna LD-a is essentially parallel to the longitudinal direction of the platform LD-p. Thus, the orientation of the plane in which the antenna 6 is rotatable is dependent on the current direction, i.e. how the extendable section 2*a* is folded in relation to the base section 2*b*.

The vehicle 5-*v*, has a front end 51 and a rear end 52 defining the longitudinal extension of the vehicle 5-*v*, i.e. the platform 5, in longitudinal direction of the platform LD-p, which according to the coordinate system of FIG. 1*a* is directed in X direction. The platform 5 also has a transverse extension, not shown, which according to the coordinate system of FIG. 1*a* is directed in Z direction. The longitudinal direction of the platform LD-p, in X direction, and the transverse extension of the platform, in Z direction, defines a horizontal plane PLxz. The upper end 4*a* of the extendable section 2*a* is arranged to the antenna 6 by means of a second pivot joint 10. The antenna 6 is foldable in the vertical plane PLxy, being parallel to the longitudinal direction of the antenna LD-a, parallel to the longitudinal direction of the extendable section LD-es and perpendicular to the horizontal plane PLxz, by means of the second pivot joint 10.

In FIG. 6*c* the antenna 6 has been folded approximately 180 degrees in the vertical plane PLxy, in relation to the orientation of the antenna 6 in FIG. 6*b*. In FIG. 6*c* the antenna 6 of the antenna system 1 is also rotated essentially 180 degrees, in relation to the orientation of the antenna 6 shown in FIG. 6*b*, such that a front surface of the antenna 6*a* is directed towards the extendable section 2*a* of the mast 7. Such rotation may e.g. be accomplished by means of a turntable 60.

Figure 6D:
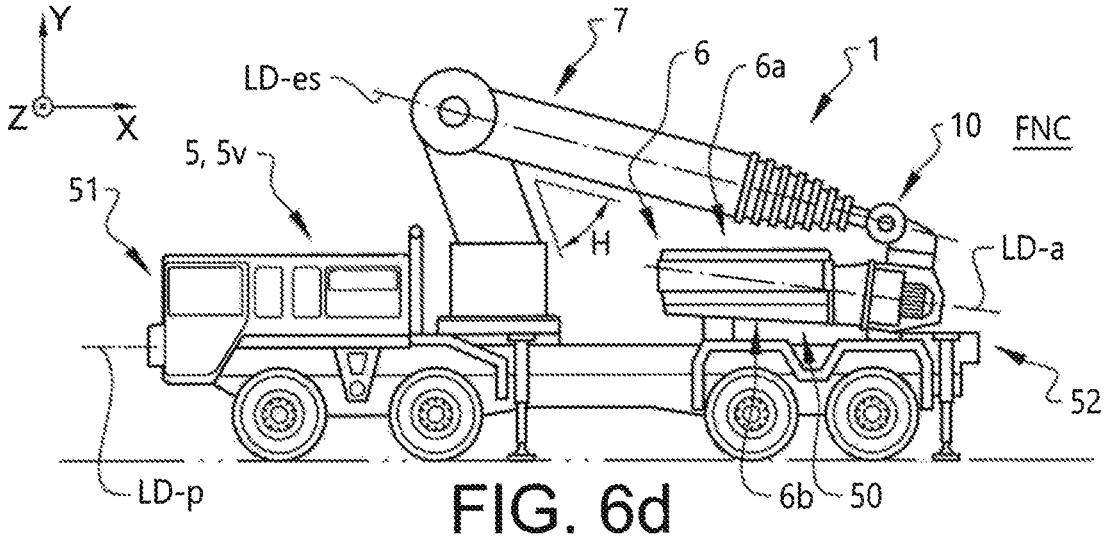

In FIG. 6*d* the antenna system 1 is in a fully nested configuration FNC. The extendable section 2*a* is folded an angle H, by means of a first pivot joint 9, in relation to the base section 2*b*, such that the back side on the antenna 6*b* is arranged to rest on the loading platform 50 of the vehicle 5-*v*. Thereby the longitudinal direction of the antenna LD-a becomes essentially parallel to the longitudinal direction of the extendable section LD-es. The loading platform 50 is preferable provided with locking means (not shown) configured to secure the antenna 6, i.e. the back surface of the antenna 6*b*, to the loading platform 50 during transport.

Figure 7:
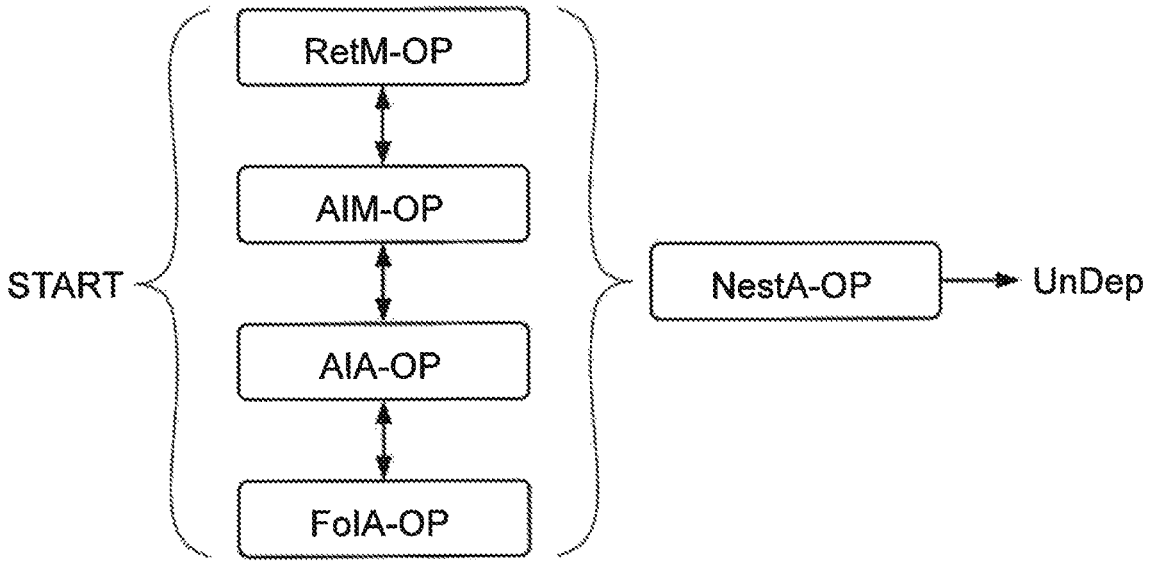

The method of undeploying, storing, packaging and/or encapsulating before transportation, an antenna system 1 of an antenna arrangement 101, which is shown in FIGS. 6*a* to 6*d*, is schematically shows as a flow chart in FIG. 7, wherein the example of the method comprises the method steps of;

when the mast 7 is in an at least partially upright and at least partially deployed configuration, retracting the extendable section 2*a* of the mast 7 such that the mast 7 adopts an essentially fully retracted configuration FRC, this is referred to as a retracting mast operation, RetM-OP, and is shown in FIG. 6*a*, directing the mast 7 by means of rotation such that the mast 7 is capable of being folded, by means of the first pivot joint 9, in a direction pointing essentially towards the rear end 52 of the vehicle 5-*v*, i.e. the mast is arranged to be foldable in the vertical plane PLxy, this is referred to as an aligning mast operation, AlM-OP, and is shown in FIG. 6*a*, rotating the antenna 6 such that a front surface of the antenna 6*a* is directed in a direction such that when being in a fully nested configuration FNC the front surface of the antenna 6*a* is directed essentially towards the extendable section 2*a*, this is referred to as an aligning antenna operation, AlA-OP, and is also shown in FIG. 6*c*, folding the antenna 6 in relation to at least a part of the extendable section 2*a* of the mast 7 in the vertical plane PLxy, by means of the second pivot joint 10, such that a longitudinal direction LD-a of the antenna 6 becomes nearly parallel, or at least as parallel as possible given the current antenna system design, to the longitudinal direction of the extendable section LD-es, and this is referred to as a folding antenna operation, FolA-OP, and is shown in FIG. 6*c*, and folding the extendable section 2*a* of the mast 7 in relation to the base section 2*b* of the mast 7 in the vertical plane PLxy, by means of the first pivot joint 9, and/or folding the antenna 6 in the vertical plane PLxy, by means of the second pivot joint 10, such that the a back surface of the antenna 6*b* is capable of resting against, the vehicle 5-*v*, or more specifically rests against the loading platform 50 of the platform 5, whereby the antenna system 1 is arranged in the fully nested configuration FNC.

this is referred to as a nesting antenna operation, NestA-OP, and is shown in FIG. 6*d*, whereby the antenna system is arranged in an fully retracted and nested configuration, herein referred to undeployed configuration, UnDep.

As is indicated in the flow chart shown in FIG. 7, the retracting operation, RetM-OP, the aligning mast operation, AlM-OP, the folding antenna operation, FolA-OP, and the folding antenna operation, FolA-OP, may be performed in any order and/or at least partly simultaneously.

The disclosed method applies both to antenna systems for which the second pivot joint is arranged to the upper end of the extendable section, as e.g. is shown in FIG. 1*a*, and to antenna systems—at least for most realizations—for which the second pivot joint is arranged between the upper end and the lower end of the extendable section, as e.g. is shown in FIG. 1*b*.

Also, various specific antenna system designs may influence e.g. to what degree the antenna can be folded in relation to the mast/extendable section, how the extendable section can be folded in relation to the base section and exactly how the antenna is arranged between the mast and the loading platform when being in a fully nested configuration. Such variations are considered to be within the scope of the present disclosure.

According to some realizations of an antenna arrangement 101, comprising an antenna system 1, according to the present disclosure, it is also possible that the nesting antenna operation NestA-OP may be done in another order in relation to the other operations, RetM-OP, AlM-OP, AlA-OP and FolA-OP, e.g. aligning antenna operation, AlA-OP.

An exemplary advantage of the method of undeploying, storing, packaging and/or encapsulating before transportation is that during transport the antenna 6 is restrained from moving whereby involuntary shaking of the antenna 6 can be avoided. Also, the front surface of antenna 6*a* will be protected against mechanical impact since the mast 7/extendable section 2*a* at least partially covers the antenna 6, i.e. the front surface of the antenna 6*a*. Yet exemplary advantages is e.g. that the antenna arrangement 101 has a low profile, which is advantageously both since it makes the antenna arrangement 101 harder to spot for enemies, as well as for making it less prone to getting stuck in the terrain, and that deploying and storing the antenna system 1 accordingly will reduce the length of the transport.

As is apparent from the description above, the disclosure of the method is not to been seen as limited to the exact order of method steps described above. Many of the described steps of the method can be performed at any time during the method or can be performed simultaneously.

As also is apparent from the description above, the method of retracting and folding the antenna system, referred to as encapsulating the antenna 6, shown in FIGS. 6*a* to 6*d*, is also applicable to an antenna arrangement comprising an antenna system and any form of platform. According to a preferred embodiment of such an antenna arrangement the platform may be a vehicle.

Hence, as is apparent from the description above, when starting from a partially or fully deployed configuration it is possible to retract the extendable section of the mast simultaneously as the antenna is folded and the antenna is rotated. What is important is that when the method is completed the extendable section is fully retracted, the extendable section is folded such that the antenna can rest on the loading platform of the vehicle, the antenna is folded such that the antenna is essentially parallel to the loading platform of the vehicle and that the front surface of the antenna is facing the extendable section of the mast.

The terminology used herein is for the purpose of describing particular examples only and is not intended to be limiting of the disclosure. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred examples and modes of operation of the present disclosure. However, the disclosure should be regarded as illustrative rather than restrictive, and not as being limited to the particular examples discussed above. The different features of the various examples of the disclosure can be combined in other combinations than those explicitly described. It should therefore be appreciated that variations may be made in those examples by those skilled in the art without departing from the scope of the present disclosure as defined by the following claims.

The invention claimed is:

1. Antenna system [1] comprising:

a mast [7], wherein the mast [7] comprises a base section [2*b*] and an extendable section [2*a*], wherein the base section [2*b*] is configured to be arrangeable to a platform [5], and an antenna [6], wherein the antenna [6] is arranged to be connected to the extendable section [2*a*] and to be rotatable in a plane essentially perpendicular to a longitudinal direction of the antenna [LD-a], wherein:

the extendable section [2*a*] comprises a plurality of telescopic sections [8] defining an adjustable length of the extendable section [2*a*] along a longitudinal axis of the mast 7, whereby the extendable section [2*a*] may adopt a retracted configuration and a deployed configuration, the base section [2*b*] is arranged to the extendable section [2*a*] by means of a first pivot joint [9], whereby the extendable section [2*a*] is foldable in relation to the base section [2*b*] in a vertical plane [PLxy] parallel to the longitudinal direction of the extendable section [LD-es] and to the longitudinal direction of the base section [LD-bs] by means of the first pivot joint [9], the extendable section [2*a*] comprises a second pivot joint [10], whereby the antenna [6] is foldable in relation to at least a part of the extendable section [2*a*] in the vertical plane [PLxy] being parallel to the longitudinal direction of the antenna [LD-a] and to the longitudinal direction of the extendable section [LD-es], by means of the second pivot joint [10], the second pivot joint [10] is arranged between an upper end [4*a*] of the extendable section [2*a*] and a lower end [4*b*] of the extendable section [2*a*], whereby a part of the extendable section connected to the antenna [2*a*'] and a part of the extendable section not connected to the antenna [2*a*"] is formed, and whereby the part of the extendable section connected to the antenna [2*a*'] is foldable in relation to the part of the extendable section not connected to the antenna [2*a*"] in the vertical plane [PLxy] being parallel to the longitudinal direction of the extendable section [LD-es] and to the longitudinal direction of the base section [LD-bs], the part of the extendable section connected to the antenna [2*a*'] comprises the plurality of telescopic sections [8] between the second pivot joint [10] and the antenna [6], and the part of the extendable section not connected to the antenna [2*a*"] comprises the plurality of telescopic sections [8] between the first pivot joint [9] and the second pivot joint [10].

2. Antenna system [1] according to claim 1, wherein:

the mast [7] comprises a base section [2*b*] and an extendable section [2*a*], wherein an upper end [3*a*] of the base section [2*b*] is arranged to a lower end [4*b*] of the extendable section [2*a*], and wherein a lower end [3*b*] of the base section [2*b*] is configured to be arrangeable to the platform [5], the antenna [6] is arranged in connection to an upper end [4*a*] of the extendable section [2*a*], and the upper end [3*a*] of the base section [2*b*] is arranged to the lower end [4*b*] of the extendable section [2*a*] by means of the first pivot joint [9].

3. Antenna system [1] according to claim 1, wherein the second pivot joint [10] is arranged between an upper end [4*a*] of the extendable section [2*a*] and the antenna [6], whereby the second pivot joint [10] connects the antenna [6] to the extendable section [2*a*], and whereby the antenna [6] is foldable in relation to the extendable section [2*a*] in the vertical plane [PLxy] being parallel to the longitudinal direction of the antenna [LD-a] and to the longitudinal direction of the extendable section [LD-es].

4. Antenna system [1] according to claim 1, wherein:

the base section [2*b*] of the mast [7] is arrangeable to the platform [5], the longitudinal and transverse extension of the platform [5] defines a horizontal plane [PLxz], and the mast [7] is configured to be rotatable in the horizontal plane [PLxz].

5. Antenna system [1] according to claim 1, wherein:

the extendable section [2*a*] comprises a plurality of telescopic sections [8], and respective innermost telescopic section [8'] is configured to slide longitudinally in and out of respective outermost telescopic section [8"] of two adjacent telescopic sections [8', 8"] steplessly.

6. Antenna system [1] according to claim 1, wherein:

the extendable section [2*a*] may adopt any configuration between a fully retracted configuration [FRC] and a fully deployed configuration [FDC], and the selected configuration of the extendable section [2*a*] together with a configuration of respective first and/or second pivot joint [9, 10] determines the operational configuration of the antenna system [1], and wherein the operational configuration selected is dependent on at least one of the following parameters:
terrain,
wind conditions,
ground conditions,
surrounding vegetation,
antenna operating mode, or
hostile situation.

7. Antenna arrangement [101], wherein the antenna arrangement [101] comprises an antenna system [1] according to claim 1 and a platform [5].

8. Antenna arrangement [101] according to claim 7, wherein an angle A between an axis [Ax-bs] extending in the longitudinal direction of the base section [LD-bs] and an axis [AX-es] extending the longitudinal direction of the extendable section [LD-es] is selected such that a centre of gravity [CoG] of the antenna [6] is longitudinally offset from where the base section [2*b*] is configured to be arrangeable to the platform [5].

9. Antenna arrangement [101] according to claim 7, wherein in that platform [5] is a vehicle [5-*v*].

10. Method of undeploying an antenna arrangement [101] comprising the antenna arrangement [101] according to claim 7, wherein:

the platform [5] is a vehicle [5-*v*] having a front end [51] and a rear end [52] defining the extension of the vehicle [5-*v*] in longitudinal direction of the vehicle [LD-p], the antenna [6] has a front surface of the antenna [6*a*] and a back surface of the antenna [6*b*], the extendable section [2*a*] comprises a second pivot joint [10], whereby by means of the second pivot joint [10] the antenna [6] is foldable in relation to at least a part of the extendable section [2*a*] in the vertical plane [PLxy], being parallel to the longitudinal direction of the antenna [LD-a] and to the longitudinal direction of the extendable section [LD-es], and the method comprises, when the mast [7] is in an at least partially upright and at least partially deployed position, the steps of:

retracting the extendable section [2*a*] of the mast [7] such that the mast [7] adopts an essentially fully retracted configuration [FRC], directing the mast [7] by means of rotation such that the mast [7] is capable of being folded, by means of the first pivot joint [9] in a direction pointing essentially towards the rear end [52] of the vehicle [5-*v*], rotating the antenna [6] such that the front surface of the antenna [6*a*] is directed in a direction such that when being in a fully nested configuration [FNC] the front surface of the antenna [6*a*] is directed towards the extendable section [2*a*] of the mast [7], and folding the extendable section [2*a*] of the mast [7] in relation to the base section [2*b*] of the mast [7] by means of the first pivot joint [9] and folding the antenna [6] in relation to at least a part of the extendable section [2*a*] by means of the second pivot joint [10] such that the back surface of the antenna [6*b*] rests against the vehicle [5-*v*], whereby the antenna system [1] is arranged in the fully nested configuration [FNC].

11. Method of avoiding oscillations for an antenna system [1] according to claim 1, wherein, given the current operational configuration and the current environmental conditions, the method comprises the method step of controlling the operational configuration of the antenna system [1] such that the natural frequency of the mast [7] differs from the excitation frequency.

12. Method of avoiding oscillations for an antenna system [1] according to claim 11, wherein, a given operational height of the antenna system [1] corresponds to a specific natural frequency of the mast [7], and a given RPM of the rotating antenna [6] corresponds to a specific excitation frequency given the current environmental conditions, wherein, given the natural frequency of the mast [7], the method comprises the method step of controlling the RPM of the rotating antenna [6] such that the excitation frequency differs from the natural frequency of the mast [7].

13. Method of avoiding oscillations for an antenna system [1] according to claim 11, wherein, a given operational height of the antenna system [1] corresponds to a specific natural frequency of the mast [7], and a given RPM of the rotating antenna [6] corresponds to a specific excitation frequency given the current environmental conditions, wherein, given the natural frequency of the mast [7], the method comprises the method step of controlling the operational height of the antenna system [1] such that the excitation frequency differs from the natural frequency of the mast [7].

* * * * *